US008985726B2

(12) United States Patent
Somete et al.

(10) Patent No.: US 8,985,726 B2
(45) Date of Patent: Mar. 24, 2015

(54) INKJET RECORDING APPARATUS

(71) Applicant: KYOCERA Document Solutions Inc., Osaka-shi, Osaka (JP)

(72) Inventors: Takashi Somete, Osaka (JP); Noriaki Furukawa, Osaka (JP); Yasuko Takaori, Osaka (JP); Susumu Hiroshima, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 14/012,930

(22) Filed: Aug. 28, 2013

(65) Prior Publication Data

US 2014/0063104 A1 Mar. 6, 2014

(30) Foreign Application Priority Data

Aug. 30, 2012 (JP) ..... 2012-190716

(51) Int. Cl.
*B41J 2/045* (2006.01)

(52) U.S. Cl.
CPC ..... *B41J 2/04581* (2013.01); *B41J 2/04508* (2013.01); *B41J 2/04513* (2013.01); *B41J 2/04536* (2013.01); *B41J 2/04571* (2013.01); *B41J 2/04588* (2013.01)
USPC ..... 347/14; 347/17

(58) Field of Classification Search
CPC ..... B41J 2/04541; B41J 2/04581; B41J 2002/14491; B41J 2/04548; B41J 2/0457; B41J 2/14201
USPC ..... 347/9, 14, 50, 57, 58, 68; 310/316.03
See application file for complete search history.

(56) References Cited

U.S. PATENT DOCUMENTS 7,438,376 B2 * 10/2008 Tamura et al. ..... 347/17
2001/0050696 A1 12/2001 Suzuki et al.

FOREIGN PATENT DOCUMENTS

| | | | |
|---|---|---|---|
| EP | 0788882 | A2 | 8/1997 |
| EP | 1174265 | A2 | 1/2002 |
| EP | 1174266 | A2 | 1/2002 |
| JP | 10006526 | A | 1/1998 |
| JP | 2003341048 | A | 12/2003 |

* cited by examiner

*Primary Examiner* — Thinh Nguyen
(74) *Attorney, Agent, or Firm* — Alleman Hall McCoy Russell & Tuttle LLP

(57) ABSTRACT

An inkjet recording apparatus according to one aspect of the present disclosure includes nozzle, pressuring chambers, piezoelectric element, ambient condition obtaining portion, application portion, and control portion. Control portion causes application portion to output ejection driving-voltage by which piezoelectric element is deformed so as to eject droplets from nozzles in printing period in printing state, and causes application portion to output vibration driving-voltage by which piezoelectric element is vibrated so as to vibrate meniscus in each nozzle in non-printing period between printing periods in printing state. Control portion changes the number of times piezoelectric element is vibrated in non-printing period, based on ambient condition obtained by ambient condition obtaining portion, or zero shear viscosity of ink which is calculated or obtained according to obtained ambient condition, and causes application portion to output vibration driving-voltage by which piezoelectric element is vibrated the number of times having been changed.

18 Claims, 12 Drawing Sheets

500

| TEMPERATURE (°C) | THE NUMBER OF VIBRATIONS (THE NUMBER OF TIMES/MINUTE) |
|---|---|
| LOW TEMPERATURE: HIGHER THAN OR EQUAL TO T1 AND LESS THAN T2 | S1 |
| INTERMEDIATE TEMPERATURE: HIGHER THAN OR EQUAL TO T2 AND LESS THAN T3 | S2 |
| HIGH TEMPERATURE: HIGHER THAN OR EQUAL TO T3 AND LESS THAN T4 | S3 |

FIG. 12

500

| TEMPERATURE (℃) | ZERO SHEAR VISCOSITY (mpa·S) | THE NUMBER OF VIBRATIONS (THE NUMBER OF TIMES/MINUTE) (THE NUMBER OF TIMES FLUSHING IS PERFORMED) |
|---|---|---|
| ⋮ | ⋮ | ⋮ |
| 30 | 5 | 500 |
| ⋮ | ⋮ | ⋮ |
| 13 | 9 | 1000 |
| ⋮ | ⋮ | ⋮ |

INKJET RECORDING APPARATUS

INCORPORATION BY REFERENCE

This application is based upon and claims the benefit of priority from the corresponding Japanese Patent Application No. 2012-190716 filed on Aug. 30, 2012, the entire contents of which are incorporated herein by reference.

BACKGROUND

The present disclosure relates to inkjet recording apparatuses.

An inkjet recording apparatus has, for example, a plurality of nozzles, pressurizing chambers, and piezoelectric elements. Ink droplets can be ejected from the plurality of nozzles. The pressurizing chambers are provided so as to communicate with the plurality of nozzles, respectively. Ink is charged into the pressurizing chambers. The piezoelectric elements are deformed by a driving voltage being applied, to eject, as ink droplets, the ink having been charged into the pressurizing chambers, from the nozzles.

Depending on an image formed on a recording paper, ink droplets may not be ejected from some of the plurality of nozzles for a long time period. The nozzles from which no ink droplets are ejected, are left in a state where a meniscus of ink is at a stop. In this case, for example, solvent contained in the ink near the meniscus evaporates, thereby increasing viscosity of the ink in the nozzles. As a result, ejection of ink droplets from the nozzles may be disturbed, or the nozzles may be clogged and thus ink droplets may not be ejected.

In recent years, an ink having a highly volatile solvent blended therein is used in order to enhance a quick-drying property for dots formed on a recording paper. Therefore, disturbance in ejection of ink droplets or non-ejecting of ink droplets as described above is more likely to occur.

On the other hand, a technique has been known in which a meniscus of an ink droplet is vibrated by minutely vibrating a piezoelectric element in order to reduce occurrence of non-ejecting of the ink droplets as described above and solve a problem that may arise after occurrence of the non-ejecting. In the technique, for example, ejection signal generation means that generates an ejection signal for ejecting ink, and minute-vibration signal generation means that periodically generates a minute-vibration signal for generating minute vibration to such a degree that ink does not eject, are provided. In the technique, waveform elements contained in the ejection signal and the minute-vibration signal are combined to generate a new driving pulse, the new driving pulse is inputted to a pressure generation element, and ink in a waiting state is minutely vibrated to prevent increase in viscosity of the ink.

SUMMARY

An inkjet recording apparatus according to one aspect of the present disclosure includes a nozzle, pressuring chambers, a piezoelectric element, an ambient condition obtaining portion, an application portion, and a control portion. The nozzle is implemented as a plurality of nozzles each of which can eject ink droplets toward a recording medium, and configured to have a meniscus of ink formed therein. The pressurizing chambers communicate with the plurality of nozzles, respectively, and ink is charged into the pressuring chambers. The piezoelectric element is deformed by a driving voltage being applied, and operates to eject the ink having been charged into the pressurizing chambers, as ink droplets, from the nozzles. The ambient condition obtaining portion can obtain an ambient condition. The application portion applies the driving voltage to the piezoelectric element. The control portion causes the application portion to output an ejection driving voltage by which the piezoelectric element is deformed so as to eject droplets from the nozzles in a printing period in a printing state, and causes the application portion to output a vibration driving voltage by which the piezoelectric element is vibrated a predetermined number of times so as to vibrate a meniscus in each nozzle in a non-printing period between printing periods in the printing state. The control portion changes the number of times the piezoelectric element is vibrated in the non-printing period, based on the ambient condition obtained by the ambient condition obtaining portion, or a zero shear viscosity of ink which is calculated or obtained according to the obtained ambient condition, and causes the application portion to output a vibration driving voltage by which the piezoelectric element is vibrated the number of times having been changed.

An inkjet recording apparatus according to another aspect of the present disclosure includes a nozzle, pressuring chambers, a piezoelectric element, an ambient condition obtaining portion, an application portion, and a control portion. The nozzle is implemented as a plurality of nozzles each of which can eject ink droplets toward a recording medium, and configured to have a meniscus of ink formed therein. The pressurizing chambers communicate with the plurality of nozzles, respectively, and ink is charged into the pressuring chambers. The piezoelectric element is deformed by a driving voltage being applied, and operates to eject the ink having been charged into the pressurizing chambers, as ink droplets, from the nozzles. The ambient condition obtaining portion can obtain an ambient condition. The application portion applies the driving voltage to the piezoelectric element. The control portion causes the application portion to output an ejection driving voltage by which the piezoelectric element is deformed so as to eject droplets from the nozzles in a printing period in a printing state, and causes the application portion to output a vibration driving voltage by which the piezoelectric element is vibrated a predetermined number of times so as to vibrate a meniscus in each nozzle in a non-printing period between printing periods in the printing state. The control portion changes the number of times the piezoelectric element is vibrated in the non-printing period, based on the ambient condition obtained by the ambient condition obtaining portion, and causes the application portion to output a vibration driving voltage by which the piezoelectric element is vibrated the number of times, per unit time, which has been changed.

An inkjet recording apparatus according to still another aspect of the present disclosure includes a nozzle, pressurizing chambers, a piezoelectric element, an ambient condition obtaining portion, an application portion, a zero shear viscosity calculating/obtaining portion, and a control portion. The nozzle is implemented as a plurality of nozzles each of which can eject ink droplets toward a recording medium, and configured to have a meniscus of ink formed therein. The pressurizing chambers communicate with the plurality of nozzles, respectively, and ink is charged into the pressurizing chambers. The piezoelectric element is deformed by a driving voltage being applied, and operates to eject the ink having been charged into the pressurizing chambers, as ink droplets, from the nozzles. The ambient condition obtaining portion can obtain an ambient condition. The application portion applies the driving voltage to the piezoelectric element. The zero shear viscosity calculating/obtaining portion calculates or obtains a zero shear viscosity of ink, based on the ambient condition obtained by the ambient condition obtaining portion. The control portion causes the application portion to output an ejection driving voltage by which the piezoelectric element is deformed so as to eject droplets from the nozzles in a printing period in a printing state, and causes the application portion to output a vibration driving voltage by which the piezoelectric element is vibrated a predetermined number of times so as to vibrate a meniscus in each nozzle in a non-printing period between printing periods in the printing state. The control portion changes the number of times the piezoelectric element is vibrated in the non-printing period, based on the zero shear viscosity calculated or obtained by the zero shear viscosity calculating/obtaining portion, and causes the application portion to output a vibration driving voltage by which the piezoelectric element is vibrated the number of times having been changed.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

BRIEF DESCRIPTION OF THE DRAWINGS

FIG. 12 shows a table that represents a relationship among a temperature, a zero shear viscosity, and the number of times a piezoelectric element is vibrated.

DETAILED DESCRIPTION

Hereinafter, an inkjet recording apparatus 1 according to an embodiment of the present disclosure will be described with reference to the drawings. Firstly, the inkjet recording apparatus 1 of the first embodiment will be described with reference to FIG. 1 to FIG. 9.

In the below description, line heads 22K, 22C, 22M, and 22Y for four colors, four ink tanks 23K, 23C, 23M, and 23Y, four pump mechanisms 24K, 24C, 24M, and 24Y, and four cleaning portions 25K, 25C, 25M, and 25Y described below may be simply referred to as "line head 22", "ink tank 23", "pump mechanism 24", and "cleaning portion 25" by omitting the identification characters, "K", "C", "M, and "Y", unless each of them is to be particularly specified.

Figure 1:
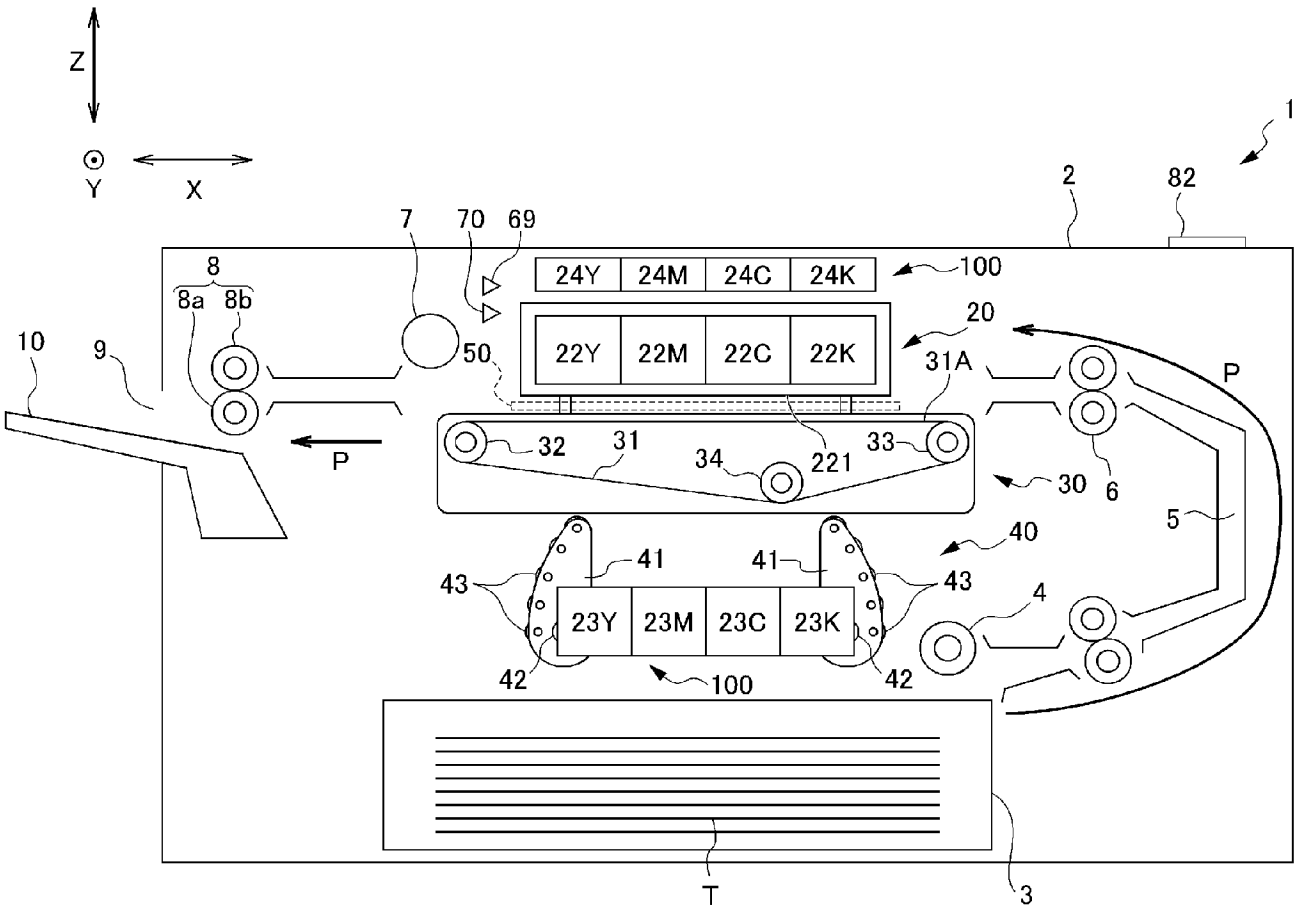
FIG. 1 is a vertical cross-sectional view schematically illustrating an outline of an inkjet recording apparatus, as viewed from the front thereof, according to a first embodiment of the present disclosure.
Figure 2:
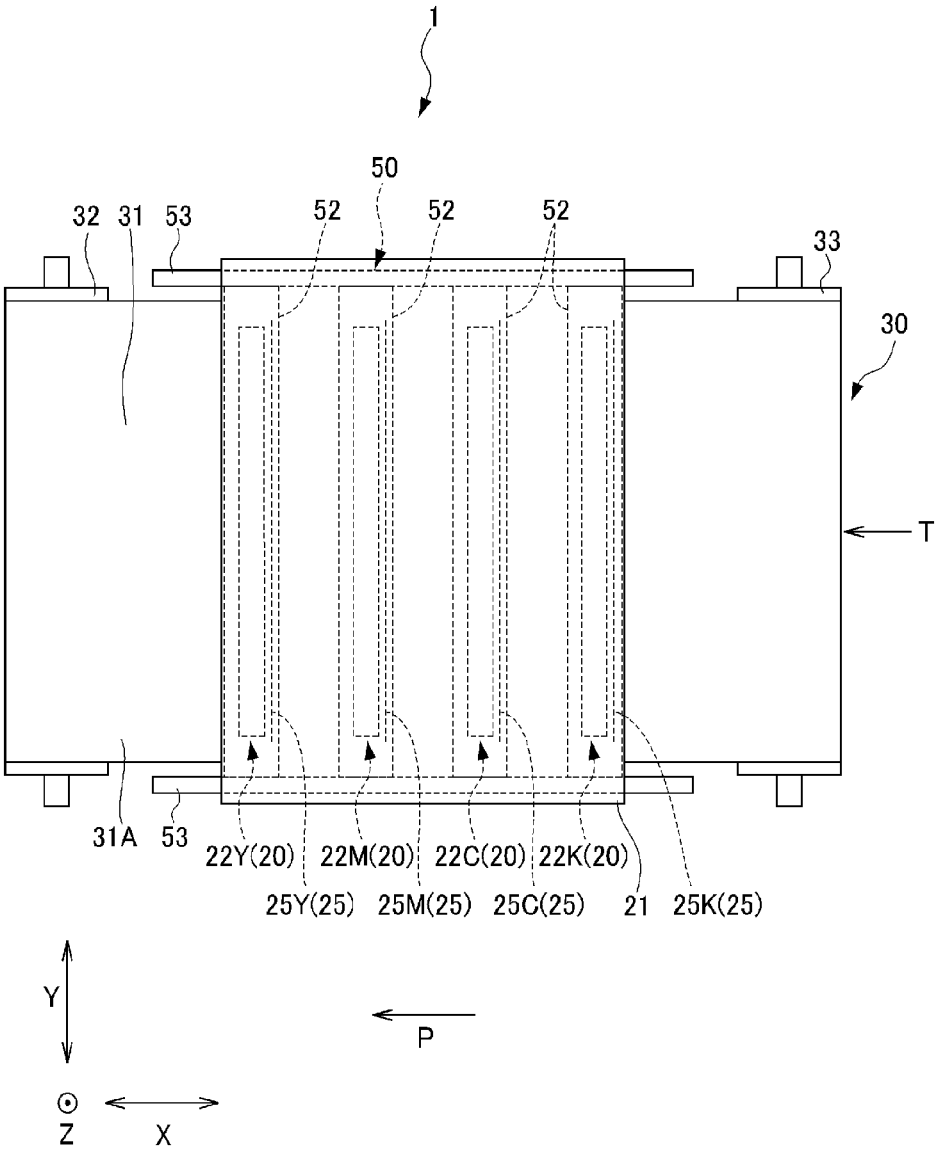
FIG. 2 is a plan view illustrating vicinities of a recording portion and a conveyor unit in a state where a cap unit is mounted to line heads in the inkjet recording apparatus of the first embodiment.

As shown in FIG. 1 and FIG. 2, the inkjet recording apparatus 1 of the first embodiment includes, in a main body 2, a recording portion 20, the cleaning portion 25, a conveyor unit 30, a lifting and lowering device 40, a cap unit 50, a first horizontal moving mechanism (not shown), and a second horizontal moving mechanism (not shown). The lifting and lowering device 40 lifts or lowers the conveyor unit 30. The first horizontal moving mechanism horizontally moves the cap unit 50. The second horizontal moving mechanism horizontally moves the cleaning portion 25. The inkjet recording apparatus 1 of the first embodiment further includes a sheet feed cassette 3, a sheet feed roller 4, a sheet conveying path 5, a pair of registration rollers 6, a drying device 7, a pair of sheet discharge rollers 8, a sheet discharge port 9, and a sheet discharge tray 10.

As shown in FIG. 1 and FIG. 2, the conveyor unit 30 includes a belt drive roller 32, a follower roller 33, a conveyor belt 31, a tension roller 34, and an air suction unit (not shown). The conveyor belt 31 is extended on the belt drive roller 32 and the follower roller 33. A tension of the conveyor belt 31 is adjusted by the tension roller 34. The air suction unit is disposed below a conveying surface of the conveyor belt 31 (on a side opposite to the recording portion 20 side). On each of the upper surfaces of the conveyor belt 31 and the air suction unit, multiple through holes (not shown) for suction are formed. Also, the belt drive roller 32 and the follower roller 33 may be named a belt roller.

The belt drive roller 32 and the follower roller 33 rotate counterclockwise as viewed from the front thereof. Thus, a conveying surface 31A formed on an upper face portion of the conveyor belt 31 is horizontally moved in a sheet conveying direction P from one side toward the other side on a horizontal plane (X-Y plane). Namely, on the conveying surface 31A of the conveyor belt 31, the sheet conveying direction P is almost equal to the horizontal direction X. The air suction unit (not shown) is disposed below the conveying surface 31A of the conveyor belt 31 (on a side opposite to the recording portion 20 side), and applies, to the conveying surface 31A, a suction force for suctioning a recording paper T as a recording medium onto the conveying surface 31A of the conveyor belt 31.

As the conveyor belt 31, an endless belt obtained by both end portions being overlapped and bonded to each other, a (seamless) belt having no joints, or the like, is used.

As shown in FIG. 2, the recording paper T as a recording medium is introduced onto the conveying surface 31A of the conveyor belt 31 from one side in the sheet conveying direction P for a predetermined recording. On the conveying surface 31A, a suction force to be applied to the conveyor belt 31 through the through holes (not shown) for suction as described above is generated according to an operation of the air suction unit (not shown). The recording paper T introduced onto the conveying surface 31A of the conveyor belt 31 is suctioned onto the conveying surface 31A due to the suction force, and conveyed downstream in the sheet conveying direction P. Thus, ink is ejected from the line head 22 of the recording portion 20 described below toward the recording paper T that is suctioned and conveyed on the conveying surface 31A of the conveyor belt 31, thereby recording (printing) an image or the like on the recording paper T.

As shown in FIG. 1, the recording papers T are stored in the sheet feed cassette 3 in a stacked state. The sheet feed cassette 3 is disposed upstream of the conveyor unit 30 in the sheet conveying direction P, and disposed in the lower inside portion of the main body 2. The sheet feed roller 4 is disposed above the sheet feed cassette 3. The recording paper T is fed from the sheet feed cassette 3 shown in FIG. 1, in the upper right direction, by the sheet feed roller 4.

The sheet conveying path 5, the pair of registration rollers 6, the recording portion 20, and the conveyor unit 30 are disposed downstream of the sheet feed cassette 3 in the sheet conveying direction P. The recording paper T fed from the sheet feed cassette 3 is conveyed through the sheet conveying path 5 and reaches the pair of registration rollers 6. The pair of registration rollers 6 corrects diagonal feeding of the recording paper T, and feeds the recording paper T again. A leading end of the recording paper T is detected by a sheet leading end detection sensor (not shown) provided in the sheet conveying path 5 between the recording portion 20 and the pair of registration rollers 6. The recording portion 20 executes ink ejecting operation as described below, based on a time at which the leading end is detected.

As shown in FIG. 1, the drying device 7 is disposed downstream of the conveyor unit 30 in the sheet conveying direction P in an upper inside portion of the main body 2. Ink on the recording paper T on which recording has been performed with the ink ejected by the recording portion 20 is dried by the drying device 7.

The pair of sheet discharge rollers 8, the sheet discharge port 9, and the sheet discharge tray 10 are disposed in order, respectively, downstream of the drying device 7 in the sheet conveying direction P. The recording paper T on which the ink has been dried by the drying device 7 is fed downstream in the sheet conveying direction P by the pair of sheet discharge rollers 8 including a discharge roller 8*a* and a follower roller 8*b* that is pressed against the discharge roller 8*a* and rotates so as to follow the discharge roller 8*a*. Then, the recording paper T is fed through the sheet discharge port 9 to the sheet discharge tray 10 disposed outside the main body 2, to be discharged to the outside of the main body 2.

As shown in FIG. 1 and FIG. 2, the recording portion 20 has the line heads 22 (head portions) corresponding to four colors. The line heads 22 corresponding to the four colors includes a line head 22K for black color, a line head 22C for cyan color, a line head 22M for magenta color, and a line head 22Y for yellow color. The line heads 22K, 22C, 22M, and 22Y for the four colors extend longitudinally along a sheet width direction Y orthogonal to the sheet conveying direction P (the horizontal direction X). The line heads 22K, 22C, 22M, and 22Y are aligned in order, respectively, from the upstream side toward the downstream side in the sheet conveying direction P along the sheet conveying direction P of the conveyor belt 31.

The line heads 22K, 22C, 22M, and 22Y corresponding to the four colors have a nozzle surface 221 in which ink ejecting nozzles are formed. The nozzle surface 221 is formed as lower surfaces of the line heads 22K, 22C, 22M, and 22Y for the four colors. The nozzle surface 221 of each of the line heads 22K, 22C, 22M, and 22Y is opposed to the conveying surface 31A of the conveyor belt 31. An image is recorded, by means of the line heads 22K, 22C, 22M, and 22Y for the four colors, on the recording paper T with ink ejected from the ink ejecting nozzles formed in the nozzle surface 221.

As shown in FIG. 1, an ink supply portion 100 has four ink tanks 23K, 23C, 23M, and 23Y, and four pump mechanisms 24K, 24C, 24M, and 24Y.

The four ink tanks 23K, 23C, 23M, and 23Y are disposed below the conveyor unit 30 so as to correspond to the line heads 22K, 22C, 22M, and 22Y for the four colors, respectively. Inks to be supplied to the line heads 22K, 22C, 22M, and 22Y for the four colors are stored in the four ink tanks 23K, 23C, 23M, and 23Y. The inks of the four colors stored in the four ink tanks 23K, 23C, 23M, and 23Y are supplied to the four pump mechanisms 24K, 24C, 24M, and 24Y, respectively, described below. The four ink tanks 23K, 23C, 23M, and 23Y are aligned in order, respectively, from the upstream side toward the downstream side in the sheet conveying direction P along the sheet conveying direction P of the conveyor belt 31.

The four pump mechanisms 24K, 24C, 24M, and 24Y are disposed above the conveyor unit 30 so as to correspond to the four ink tanks 23K, 23C, 23M, and 23Y, respectively. The four pump mechanisms 24K, 24C, 24M, and 24Y are aligned in order, respectively, from the upstream side toward the downstream side in the sheet conveying direction P along the sheet conveying direction P of the conveyor belt 31. The four pump mechanisms 24K, 24C, 24M, and 24Y temporarily store the inks of the four colors having been stored in the four ink tanks 23K, 23C, 23M, and 23Y, respectively. The inks of the four colors stored in the four pump mechanisms 24K, 24C, 24M, and 24Y are supplied to the line heads 22K, 22C, 22M, and 22Y for the four colors from the four pump mechanisms 24K, 24C, 24M, 24Y, respectively. The ink supply portion 100 will be described below in detail.

Inks of the four colors are ejected by the line heads 22, respectively, of the recording portion 20 toward the recording paper T set on the conveying surface 31A of the conveyor belt 31 according to image data information (for example, characters, figures, patterns) received from an external computer (not shown). As shown in FIG. 2, each line head 22 is supported by a line head support member 21 having a rectangular-plate-like shape, and each line head 22 and the line head support member 21 are both secured to the main body 2. Inks of the four colors are sequentially ejected from the respective line heads 22 at predetermined times, according to the rotation of the conveyor belt 31, and therefore the inks of the four colors, that is, black, cyan, magenta, and yellow colors, are superimposed on the recording paper T, thereby printing a color ink image.

As shown in FIG. 1, the lifting and lowering device 40 is disposed below the conveyor unit 30. The lifting and lowering device 40 lifts or lowers (moves) the conveyor unit 30 relative to the line head 22 in a direction Z (hereinafter, also referred to as "up-down direction Z") perpendicular to the horizontal plane (the X-Y plane). By the movement of the conveyor unit 30 in the up-down direction Z by the lifting and lowering device 40, the conveying surface 31A of the conveyor belt 31 can be moved so as to be relatively closer to or farther from the nozzle surface 221 of the line head 22.

As shown in FIG. 1, the lifting and lowering device 40 includes two eccentric cams 41. The eccentric cams 41 are disposed below the conveyor belt 31 on the upstream side and the downstream side, respectively, in the sheet conveying direction P. The eccentric cams 41 are disposed such that the two eccentric cams 41 are disposed near each of a front face side and a rear face side of the conveyor unit 30, and the total number of the eccentric cams 41 is four. The eccentric circumferential surface of each eccentric cam 41 approaches the outer bottom surface of the conveyor unit 30 from below the conveyor unit 30. As shown in FIG. 1, each eccentric cam 41 includes: a shaft 42 that extends in the sheet width direction Y; and a cam having a rotation axis line that is eccentrically located. Each eccentric cam 41 rotates about the shaft 42 by means of a motor (not shown). Each eccentric cam 41 includes a plurality of bearings 43 on the circumferential edge portion. A portion of the circumferential surface of each bearing 43 projects outward from the circumferential surface of the eccentric cam 41.

Each bearing 43 is rotatable about an axis line parallel to the rotation axis line of the eccentric cam 41. The bearings 43 are sequentially disposed from the top end side toward the rotation axis line side in each eccentric cam 41. In a normal printing state, as shown in FIG. 1, the bearing 43 that is farthest from the shaft 42 abuts against the outer bottom surface of the conveyor unit 30 from therebelow. Thus, the conveyor unit 30 is lifted to an uppermost position.

In this state, the eccentric cams 41 on the upstream side in the sheet conveying direction P are rotated counterclockwise as viewed from the front thereof, and the eccentric cams 41 on the downstream side in the sheet conveying direction P are rotated clockwise as viewed from the front thereof. Thus, the plurality of bearings 43 sequentially abut against the outer bottom surface of the conveyor unit 30 in the order starting from the bearing 43 farthest from the shaft 42 toward the bearing 43 closest to the shaft 42. Therefore, the conveyor unit 30 can be lowered.

The plurality of bearing 43 are spaced from each other so as to include a period in which two of the bearings 43 adjacent to each other in the circumferential edge direction simultaneously abut against the outer bottom surface of the conveyor unit 30 when the eccentric cams 41 rotate.

The conveyor unit 30 is lowered by the eccentric cams 41 of the lifting and lowering device 40 being rotated, whereby the conveying surface 31A of the conveyor belt 31 in the conveyor unit 30 is moved downward of the line head 22 so as to be spaced from the line head 22.

As shown in FIG. 1, the cap unit 50 is disposed below the recording portion 20 and above the conveyor unit 30 (between the recording portion 20 and the conveyor unit 30). As shown in FIG. 2, the cap unit 50 includes a plurality of cap cases 52 disposed so as to correspond to the line heads 22, respectively, and cap base members 53 that fix and support the plurality of cap cases 52 so as to satisfy a predetermined positional relationship.

The cap unit 50 can be lifted or lowered in conjunction with the conveyor unit 30 being lifted or lowered by the lifting and lowering device 40 in a state where the cap unit 50 is positioned between the recording portion 20 and the conveyor unit 30. The conveyor unit 30 is lowered by the eccentric cams 41 of the lifting and lowering device 40 being rotated, whereby the cap unit 50 is moved downward of the line head 22 so as to be spaced from the line head 22 in conjunction with the conveying surface 31A of the conveyor belt 31 being lowered.

Thus, the cap unit 50 is detached from the line head 22. Ink is emitted from ink emitting nozzles described below in the nozzle surface 221 of the line head 22 in a state where the cap unit 50 is detached from the line head 22, and thus the inkjet recording apparatus 1 can execute an ejection recovery process of emitting ink that has a high viscosity and is left in the nozzles, to remove the clogging with ink, that is, execute purging.

On the other hand, when the eccentric cams 41 of the lifting and lowering device 40 are rotated in the direction opposite to the direction described above, to lift the conveyor unit 30, the conveyor unit 30 is returned to a normal recording position (printing position).

In a state where the cap unit 50 is disposed between the recording portion 20 and the conveyor unit 30, the cap unit 50 can be mounted to the nozzle surface 221 of the line head 22. Further, in a state where, by the cap unit 50 having been moved by the first horizontal moving mechanism (not shown) described below, the cap unit 50 is not disposed between the recording portion 20 and the conveyor unit 30, the line head 22 is allowed to eject ink toward the recording paper T on the conveying surface 31A of the conveyor belt 31.

The cap unit 50 can be moved horizontally in the sheet conveying direction P (see FIG. 1) by the cap base members 53 being horizontally moved by the first horizontal moving mechanism (not shown).

The cap unit 50 is moved, by the first horizontal moving mechanism, to a mounting and detaching position at which the cap cases 52 can be mounted to or detached from the line heads 22, or to a retracting position that is distant form the mounting and detaching position in the horizontal direction. The cap unit 50 is positioned at the retracting position when the recording portion 20 performs a recording operation.

The cleaning portion 25 can be disposed below the cap unit 50 and above the conveyor unit 30 (between the cap unit 50 and the conveyor unit 30). The cleaning portion 25 can be lifted or lowered in conjunction with the conveyor unit 30 being lifted or lowered by the lifting and lowering device 40 in a state where the cleaning portion 25 is positioned between the cap unit 50 and the conveyor unit 30, similarly to the cap unit 50.

Further, the cleaning portion 25 can be moved horizontally in the sheet conveying direction P (see FIG. 1) by the second horizontal moving mechanism (not shown). The cleaning portions 25 are moved by the second horizontal moving mechanism to wiping positions, below the line heads 22, at which the cleaning portions 25 are allowed to clean the line heads 22, respectively, or moved to retracting positions that are distant from the wiping positions in the horizontal direction. When the recording portion 20 performs a recording operation or the cap unit 50 is mounted to the nozzle surface 221 (see FIG. 3) of the line heads 22, the cleaning portions 25 are positioned at the retracting positions.

Figure 3:
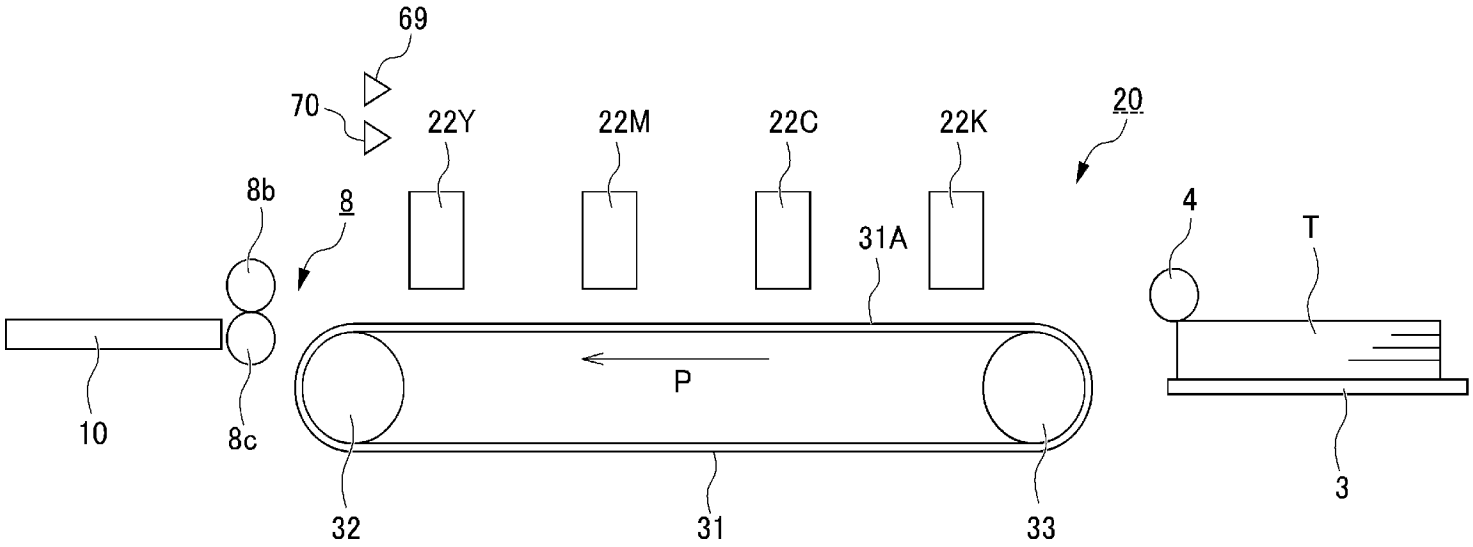
FIG. 3 illustrates side faces of the line heads and a conveyor belt shown in FIG. 1.

Subsequently, with reference to FIG. 3 to FIG. 5, the line heads 22K to 22Y will be described in detail. As shown in FIG. 3, the sheet feed cassette 3 in which the recording papers T are stored is disposed in the right side portion of the inkjet recording apparatus 1. The sheet feed roller 4 is disposed at one end portion of the sheet feed cassette. The sheet feed roller 4 operates to convey the stored recording papers T one by one sequentially from the recording paper T at the uppermost position, to the conveyor belt 31 described below.

The conveyor belt 31 that conveys the recording paper T is rotatably disposed downstream (the left side in FIG. 3) of the sheet feed roller 4 in the sheet conveying direction. The conveyor belt 31 is extended on the belt drive roller 32 that is disposed on the downstream side in the sheet conveying direction P and driven so as to rotate, and the follower roller 33 that is disposed on the upstream side in the sheet conveying direction P and rotates so as to follow the belt drive roller 32 by means of the conveyor belt 31. The conveyor belt 31 conveys the recording paper T in the sheet conveying direction by the belt drive roller 32 being driven to rotate counterclockwise. The recording paper T is preferably conveyed at, for example, 50 m/min., or faster. However, the present disclosure is not limited thereto.

Since the belt drive roller 32 is disposed on the downstream side in the sheet conveying direction P, the sheet conveying side portion (the upper side portion in FIG. 1) of the conveyor belt 31 is drawn by the belt drive roller 32. Therefore, the conveyor belt 31 is drawn at a predetermined belt tension, whereby the recording paper T can be stably conveyed. For the conveyor belt 31, a dielectric resin sheet is used. As the conveyor belt 31, for example, a (seamless) belt having no joints is particularly advantageously used.

Further, the pair of sheet discharge rollers 8 is disposed downstream of the conveyor belt 31 in the sheet conveying direction P. The pair of sheet discharge rollers 8 is driven to rotate counterclockwise in FIG. 3, and discharges the recording paper T on which an image is recorded, externally from the main body of the apparatus. The sheet discharge tray 10 on which the recording papers T discharged externally from the main body of the apparatus are stacked, is disposed downstream of the pair of sheet discharge rollers 8.

Further, the line heads 22K, 22C, 22M, and 22Y are disposed above the conveyor belt 31. The line heads 22K, 22C, 22M, and 22Y are supported at such a height that the line heads 22K, 22C, 22M, and 22Y are each spaced from the upper surface of the conveyor belt 31 by a predetermined distance, and an image is recorded, by the line heads 22K, 22C, 22M, and 22Y, on the recording paper T conveyed on the conveyor belt 31. In the inkjet recording apparatus 1, a color image is formed on the recording paper T by inks corresponding to the colors being ejected from the line heads 22K to 22Y, respectively.

Figure 4:
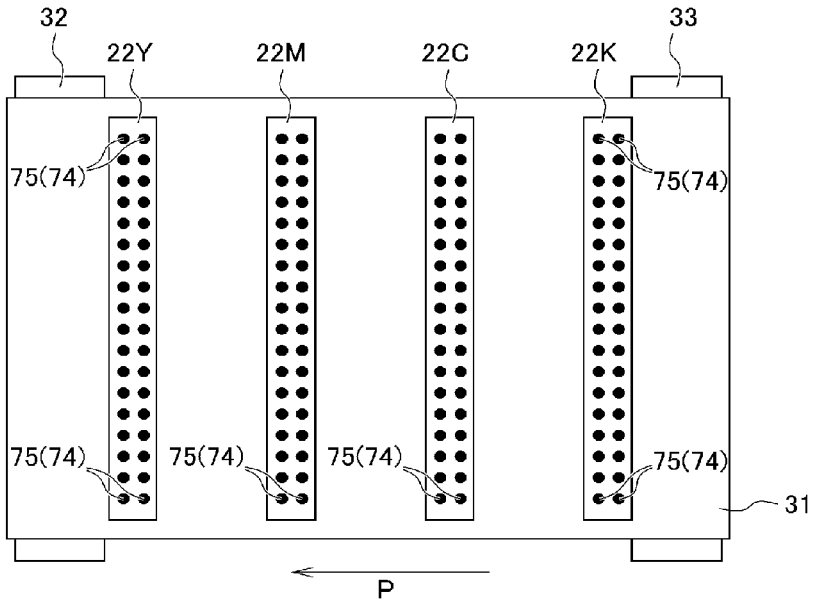
FIG. 4 is a plan view illustrating the conveyor belt of the inkjet recording apparatus shown in FIG. 3, as viewed from thereabove.

As shown in FIG. 3 and FIG. 4, each of the line heads 22K to 22Y includes nozzle arrays each having a plurality of nozzles aligned in a direction (the up-down direction in FIG. 4) orthogonal to the conveying direction. The line heads 22K to 22Y each have a recording region having a dimension greater than or equal to a width of the recording paper T to be conveyed, and are able to record, at one time, one line of an image on the recording paper T conveyed on the conveyor belt 31.

In the present embodiment, the inkjet recording apparatus uses a line head type recording mode in which a line head is structured so as to include a recording region that has a dimension greater than or equal to a width of the recording paper T, by a plurality of nozzles being aligned in a longitudinal direction of a head main body having a longer dimension greater than or equal to a width dimension of the conveyor belt 31. However, the present disclosure is not limited thereto. The inkjet recording apparatus may use a line head type recording mode in which, for example, a line head is used in which a plurality of head units each having a plurality of nozzles are aligned, so as to have a shorter dimension, in a width direction of the conveyor belt 31, thereby recording an image over the entirety of a region, in the width direction, of the conveyed recording paper T.

Further, in the present embodiment, a mode in which inks are ejected from the line heads 22K to 22Y is a piezoelectric element mode in which piezoelectric elements described below are used to eject ink droplets by utilizing pressure generated in pressurizing chambers 76 for the line heads 22K to 22Y. In the piezoelectric element mode, ink droplets are ejected by utilizing pressure generated in each pressurizing chamber 76 through voltage control, thereby facilitating control of an ejection amount. Further, in the piezoelectric element mode, by voltage control, pressure generated in each pressurizing chamber 76 is adjusted to vibrate a meniscus of the ink, and further the magnitude and cycle of the vibration can be adjusted.

Figure 5:
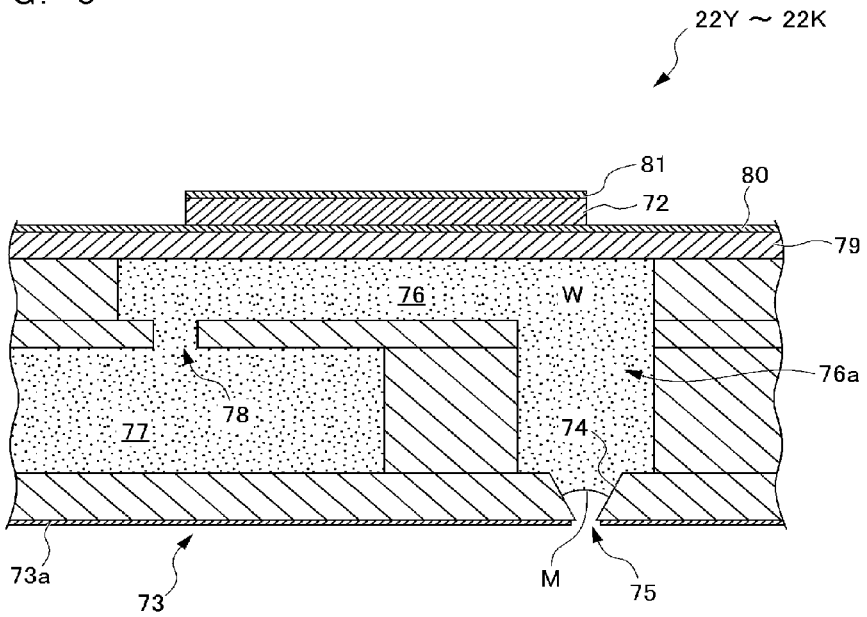
FIG. 5 is a cross-sectional view of one of the head lines shown in FIG. 1.

Subsequently, as shown in FIG. 5, the line heads 22K to 22Y using the piezoelectric element mode each includes: a water-repellent film 73*a* that covers a portion other than an ink outlet 75 of an ejection surface 73; the pressurizing chamber 76 provided for each ink outlet 75; an ink tank (not shown) in which ink is stored; and a common flow path 77 through which ink is supplied from the ink tank to the plurality of pressurizing chambers 76. Each pressurizing chamber 76 and the common flow path 77 communicate with each other through a supply opening 78. Ink is supplied from the common flow path 77 through the supply opening 78 to each pressurizing chamber 76.

A nozzle 74 and the pressurizing chamber 76 connect to each other through a nozzle flow path 76*a*. A plurality of the nozzles 74 (see FIG. 4) are formed in the line head 22. Ink droplets can be ejected from each of the plural nozzles 74 toward the recording paper T (recording medium). A meniscus M can be formed in each of the plural nozzles 74. The plurality of the pressurizing chambers 76 are provided so as to communicate with the plurality of nozzles 74, respectively, and an ink W is charged into each pressuring chamber 76.

A wall of each pressurizing chamber 76 on a side opposite to the ejection surface 73 side is formed as a vibration plate 79. The vibration plate 79 is continuously formed over a plurality of the pressurizing chambers 76. Over a surface of the vibration plate 79 on a side opposite to the pressurizing chamber 76 side, a common electrode 80 is layered. The common electrode 80 is continuously disposed over regions corresponding to the plurality of the pressurizing chambers 76.

On a surface of the common electrode 80 on a side opposite to the vibration plate 79 side, a plurality of piezoelectric elements 72 are disposed. The plurality of piezoelectric elements 72 are disposed on the surface of the common electrode 80 on the side opposite to the vibration plate 79 side so as to correspond to the pressurizing chambers 76, respectively. On surfaces of the plurality of piezoelectric elements 72 on a side opposite to the common electrode 80 side, a plurality of individual electrodes 81, respectively, are disposed. The plural piezoelectric elements 72 are deformed due to a driving voltage applied through the individual electrodes 81, respectively, described below by a line head control circuit 66, and enable the ink W having been charged into the plural pressurizing chambers 76 to be ejected as ink droplets from the plural nozzles 74, respectively. Further, each of the plural piezoelectric elements 72 is deformed due to a driving voltage applied through a corresponding one of the individual electrodes 81 by the line head control circuit 66, and is vibrated a predetermined number of times per unit time. The meniscus M is vibrated by each of the plural piezoelectric elements 72.

Each of the plural individual electrodes 81 is disposed so as to sandwich a corresponding one of the plural piezoelectric elements 72 between the individual electrode 81 and the common electrode 80. The plurality of individual electrodes 81 are disposed so as to correspond to the pressurizing chambers 76, respectively. Each individual electrode 81 outputs (applies), to a corresponding one of the piezoelectric elements 72, an ejection driving voltage and a vibration driving voltage outputted from the line head control circuit 66. Each individual electrode 81 outputs, to a corresponding one of the piezoelectric elements 72, the ejection driving voltage outputted from the line head control circuit 66 in a printing period, and outputs, to the corresponding one of the piezoelectric elements 72, the vibration driving voltage outputted from the line head control circuit 66 in a non-printing period.

As described above, when the vibration driving voltage is applied through the plurality of individual electrodes 81 by the line head control circuit 66, each of the plural piezoelectric elements 72 vibrates a predetermined number of times per unit time for a predetermined vibration period. In other words, each of the plural piezoelectric elements 72 vibrates a predetermined number of times. Thus, the meniscus M formed in each of the plural nozzles 74 vibrates.

Figure 6:
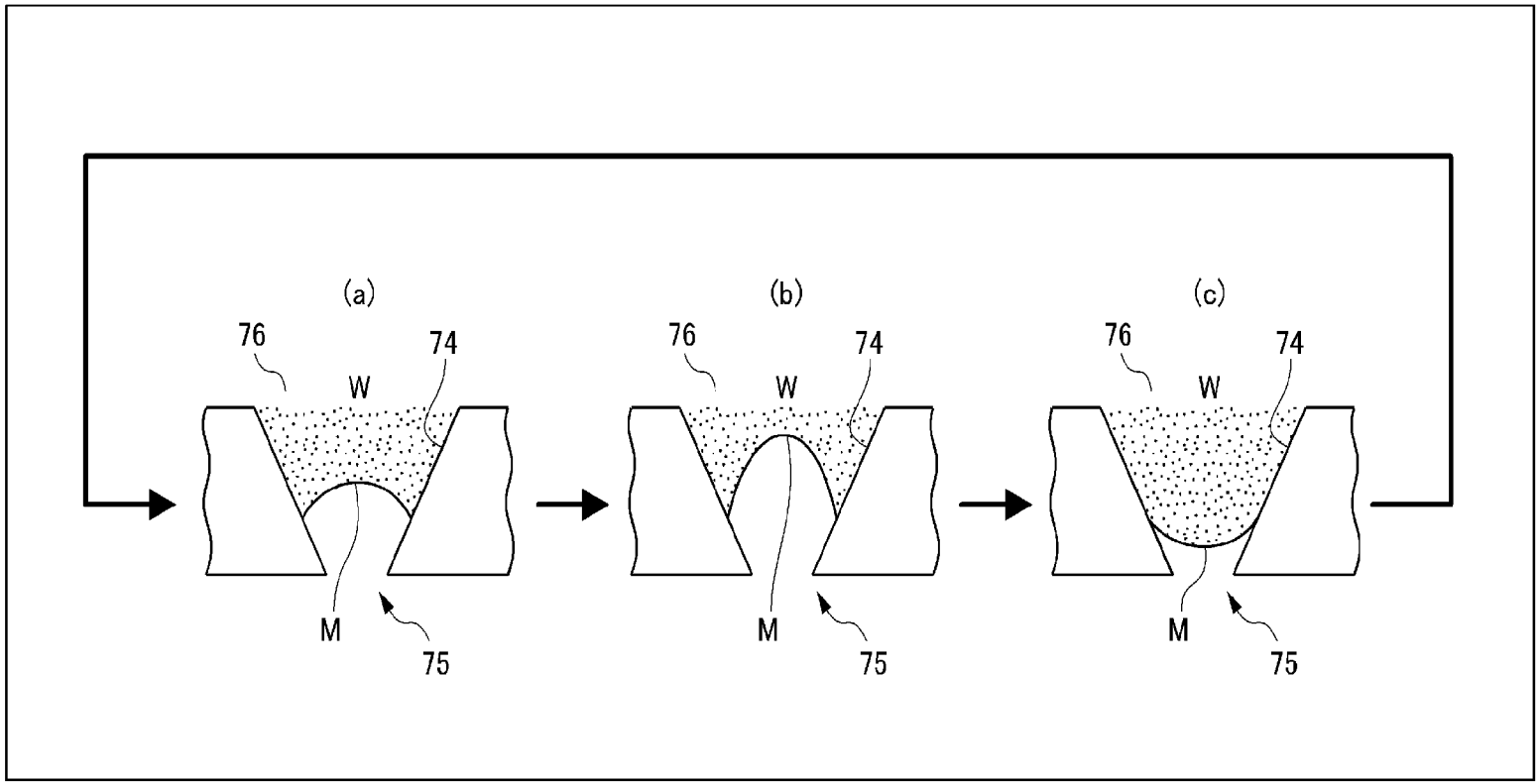
FIG. 6 illustrates a process of meniscus vibrating in a meniscus vibration operation.

Subsequently, with reference to FIG. 6, vibration of the meniscus in a meniscus vibration operation will be described. Firstly, in a state where the ink W has been charged into the pressurizing chambers 76, the meniscus M is formed in each of the plural nozzles 74. The meniscus M near the ink outlet 75 in a stationary state as shown in (a) of FIG. 6, is drawn into the pressurizing chamber 76 as shown in (b) of FIG. 6, when a vibration driving voltage is applied to the piezoelectric element 72. Subsequently, in a state where no vibration driving voltage is applied, the meniscus M expands outward of the pressurizing chamber 76 as shown in (c) of FIG. 6, in reaction to the meniscus having been drawn into the pressurizing chamber 76. The meniscus M repeatedly vibrates (oscillates) plural times with an amplitude being gradually reduced, and converges to a stationary state as shown in (a) of FIG. 6. Thus, a meniscus vibration including a series of operations as shown in (a) to (c) of FIG. 6 occurs in the meniscus M by a driving voltage being applied once to the piezoelectric element 72.

A vibration manner for the meniscus M is determined according to vibration conditions (the number of times the piezoelectric element is vibrated, the number of vibrations per unit time, vibration period) in the piezoelectric element 72. The number of times the piezoelectric element 72 is vibrated is determined by a control portion 60. The control portion 60 changes the number of times the piezoelectric element 72 is vibrated. The control portion 60 changes the number of times the piezoelectric element 72 is vibrated, by changing the vibration period, the number of vibrations per unit time, and the like. For example, when the number of vibrations per unit time is constant, the control portion 60 increases the vibration period, thereby increasing the number of times the piezoelectric element 72 is vibrated.

Specifically, the control portion 60 determines the number of times the piezoelectric element 72 is vibrated, according to a temperature obtained by a temperature sensor 70. The control portion 60 outputs, to the line head control circuit 66, a vibration driving signal that includes information about the number of times the piezoelectric element 72 is to be vibrated. When receiving the vibration driving signal, the line head control circuit 66 applies a vibration driving voltage to the piezoelectric element 72 so as to vibrate the piezoelectric element 72 the number of times indicated in the vibration driving signal. Thus, the meniscus M vibrates according to the vibration of the piezoelectric element 72. For example, the number of times the piezoelectric element 72 is vibrated is set so as to be less than or equal to 2000, and is preferably set so as to be greater than or equal to 400, and not greater than 1500.

The control portion 60 causes the line head control circuit 66 (application portion) to output a vibration driving voltage by which the piezoelectric element 72 is vibrated a predetermined number of times so as to vibrate the meniscus M in a non-printing period in a printing state in the inkjet recording apparatus 1. The printing state represents a state where a printing job is being executed by the inkjet recording apparatus 1. The printing state includes a printing period during which characters and/or images are formed (inks are ejected from the nozzles), and a non-printing period between the printing period and the immediately following printing period.

The control portion 60 causes the line head control circuit 66 (application portion) to output a vibration driving voltage by which the piezoelectric element 72 is vibrated a predetermined number of times so as to vibrate the meniscus M, in the entirety or a portion of the printing period in the printing state. The control portion 60 may cause the line head control circuit 66 (application portion) to output the vibration driving voltage as described above in a non-printing period in the printing state, such as in a period when the nozzle 74 opposes a region between the papers T being conveyed. The control portion 60 may cause the line head control circuit 66 (application portion) to output the vibration driving voltage so as to vibrate the meniscus M in a so-called paper interval.

In this case, for example, in a case where the inkjet recording apparatus 1 performs printing at a rate of 150 pieces/minute, the control portion 60 may cause the line head control portion 66 (application portion) to output the vibration driving voltage so as to vibrate the meniscus M during only a predetermined time period (for example, 0.1 seconds) in a period (for example, 0.15 seconds) from a time when a rear end of the paper T is positioned so as to oppose a predetermined one of the nozzles 74, to a time when a leading end of the immediately following paper T is positioned so as to oppose the nozzle 74.

The control portion 60 may cause the line head control circuit 66 (application portion) to output the vibration driving voltage so as to vibrate the meniscus M in each and every paper interval. Further, the control portion 60 may cause the line head control circuit 66 (application portion) to output the vibration driving voltage so as to vibrate the meniscus M every predetermined number of paper intervals, instead of in each and every paper interval.

Figure 7:
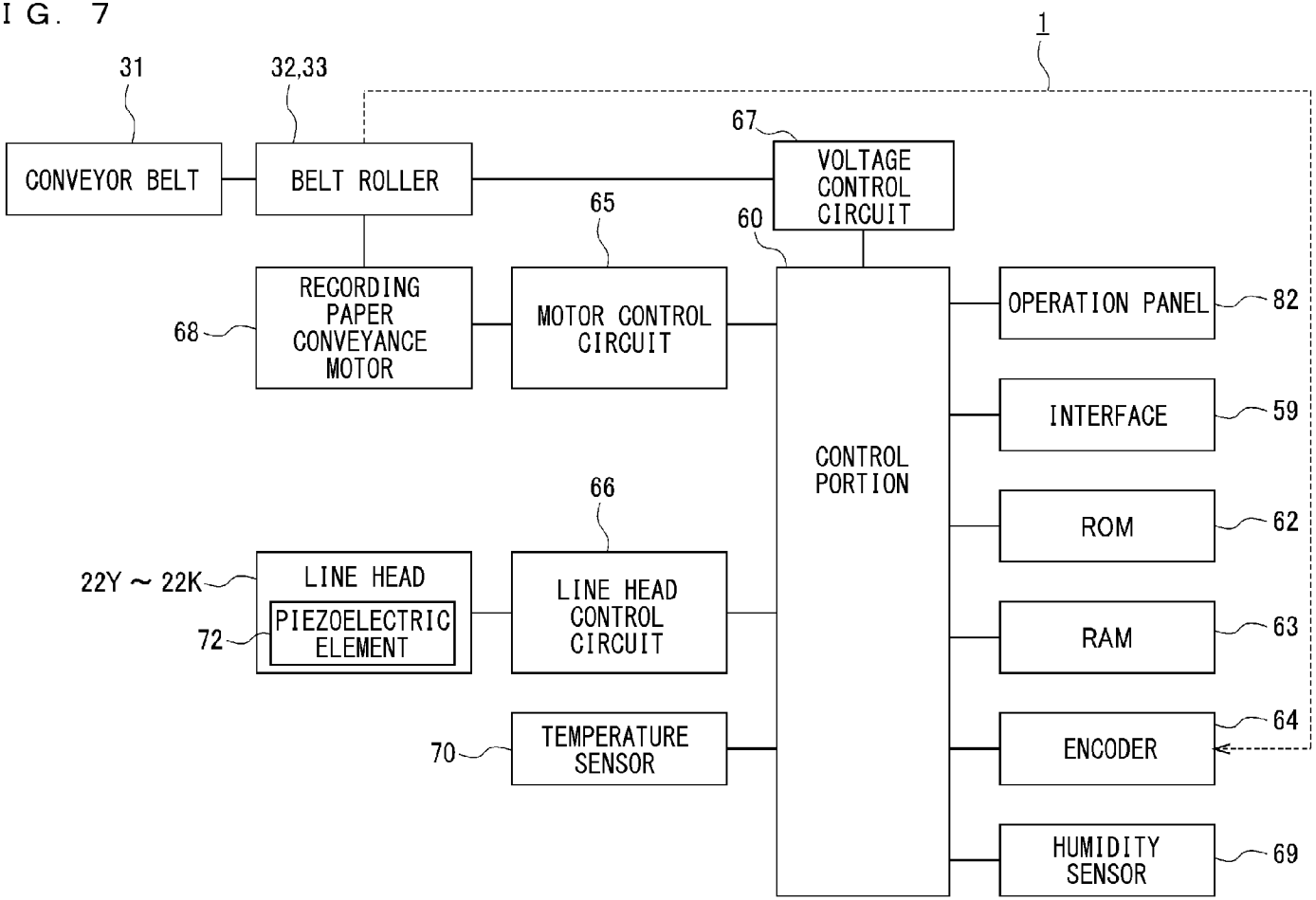
FIG. 7 is a block diagram illustrating a configuration of the inkjet recording apparatus according to the first embodiment.

Subsequently, with reference to FIG. 7 and FIG. 8, a configuration of the inkjet recording apparatus of the first embodiment will be described. The inkjet recording apparatus 1 includes an interface 59, the control portion 60, a ROM 62, a RAM 63, an encoder 64, a motor control circuit 65, the line head control circuit 66, a voltage control circuit 67, a humidity sensor 69, and the temperature sensor 70.

The interface 59 performs data transmission and reception with, for example, a not-illustrated host device such as a personal computer.

The control portion 60 subjects an image signal received through the interface 59 to a scaling process or a gradation process as appropriate, to convert the image signal to image data. The control portion 60 outputs control signals to various control circuits described below.

Further, the control portion 60 can output an ejection driving signal and a vibration driving signal to the line head control circuit 66 (application portion). The control portion 60 causes the line head control circuit 66 to output an ejection driving voltage by which the piezoelectric element 72 is deformed so as to eject droplets from the nozzle 74 in the printing period, and causes the line head control circuit 66 to output a vibration driving voltage by which the piezoelectric element 72 is vibrated a predetermined number of times so as to vibrate the meniscus M in the nozzle 74 in the non-printing period.

The control portion 60 outputs, to the line head control circuit 66, a vibration driving signal containing information about the number of times the piezoelectric element 72 is to be vibrated, thereby causing the line head control circuit 66 to output the ejection driving voltage or the vibration driving voltage.

Further, the control portion 60 controls, via the line head control circuit 66, ejection of the ink W from each nozzle 74 and vibration of the meniscus M in the ink W.

In the present embodiment, the control portion 60 changes the number of times the piezoelectric element 72 is vibrated by changing a vibration period during which the piezoelectric element 72 is vibrated, and causes the line head control circuit 66 (application portion) to output a vibration driving voltage by which the piezoelectric element 72 is vibrated the number of times having been changed. The control portion 60 outputs, to the line head control circuit 66, a vibration driving signal containing information about the number of times the piezoelectric element 72 is to be vibrated per unit time, and a vibration period, thereby causing the line head control circuit 66 to output the vibration driving voltage. The control portion 60 outputs, to the line head control circuit 66, the vibration driving signal containing information about the vibration period having been changed. Thus, the line head control circuit 66 outputs a vibration driving voltage by which the piezoelectric element 72 is vibrated for the vibration period having been changed.

The control portion 60 changes the number of times the piezoelectric element 72 is vibrated in the non-printing period in the printing state, based on a temperature (ambient conditions) obtained by the temperature sensor 70 (ambient condition obtaining portion), and causes the line head control circuit 66 to output a vibration driving voltage by which the piezoelectric element 72 is vibrated the number of times having been changed.

Namely, the control portion 60 determines (changes) the number of times the piezoelectric element 72 is vibrated, according to a temperature obtained by the temperature sensor 70. The control portion 60 outputs, to the line head control circuit 66, a vibration driving signal (for example, pulse signal) containing information about the number of times the piezoelectric element 72 is to be vibrated. The line head control circuit 66 outputs, to the piezoelectric element 72, a vibration driving voltage by which the piezoelectric element 72 is vibrated the number of times having been determined (changed).

In other words, the control portion 60 determines (changes) a vibration period during which the piezoelectric element 72 is vibrated, according to a temperature obtained by the temperature sensor 70. The control portion 60 outputs, to the line head control circuit 66, the vibration driving signal containing information about the number of times the piezoelectric element 72 is vibrated per unit time, and the vibration period. The line head control circuit 66 outputs, to the piezoelectric element 72, a vibration driving voltage by which the piezoelectric element 72 is vibrated the predetermined number of times (which is constant in the present embodiment) per unit time, during the vibration period having been determined (changed).

The control portion 60 determines (changes) the number of times the piezoelectric element 72 is vibrated, with reference to a table 500 (see FIG. 8) stored in the ROM 62 described below, based on the temperature obtained by the temperature sensor 70.

In the present embodiment, when the temperature is higher than or equal to T1 and less than T2, the control portion 60 causes the line head control circuit 66 to output a vibration driving voltage by which the piezoelectric element 72 is vibrated S1 (times). Further, when the temperature is higher than or equal to T2 and less than T3, the control portion 60 causes the line head control circuit 66 to output a vibration driving voltage by which the piezoelectric element 72 is vibrated S2 (times). When the temperature is higher than or equal to T3, the control portion 60 causes the line head control circuit 66 to output a vibration driving voltage by which the piezoelectric element 72 is vibrated S3 (times). Each of S1, S2, and S3 represents the number of times the piezoelectric element 72 is vibrated in each non-printing period (for example, each paper interval).

Further, the control portion 60 executes a first mode and a second mode. In the first mode, the number of times the piezoelectric element 72 is vibrated in the non-printing period is changed based on a humidity condition (ambient conditions) obtained by the humidity sensor 69 (ambient condition obtaining portion), and the line head control circuit 66 is not caused to output a vibration driving voltage by which the piezoelectric element 72 is vibrated the number of times having been changed. In the second mode, the number of times the piezoelectric element 72 is vibrated in the non-printing period is changed based on a temperature condition (ambient conditions) obtained by the temperature sensor 70 (ambient condition obtaining portion), and the line head control circuit 66 is caused to output a vibration driving voltage by which the piezoelectric element 72 is vibrated the number of times having been changed. The control portion 60 can switch between the first mode and the second mode, based on the humidity condition obtained by the humidity sensor 69 (ambient condition obtaining portion).

Namely, when a humidity obtained by the humidity sensor 69 is higher than a predetermined threshold value, the control portion 60 switches to the first mode. In the first mode, the control portion 60 changes the number of times the piezoelectric element 72 is vibrated in the non-printing period, and does not cause the line head control circuit 66 to output a vibration driving voltage by which the piezoelectric element 72 is vibrated the number of times having been changed. In the first mode, the control portion 60 does not change the number of times the piezoelectric element 72 is vibrated in the non-printing period, or does not cause the line head control circuit 66 to output a vibration driving voltage by which the piezoelectric element 72 is vibrated the number of time having been changed.

On the other hand, when a humidity obtained by the humidity sensor 69 is less than or equal to the predetermined threshold value, the control portion 60 switches to the second mode. In the second mode, the control portion 60 changes the number of times the piezoelectric element 72 is vibrated in the non-printing period, and causes the line head control circuit 66 to output a vibration driving voltage by which the piezoelectric element 72 is vibrated the number of times having been changed.

In the ROM 62, a control program and the like according to which the line heads 22K to 22Y are driven to record an image, are stored. In the RAM 63, data of images having been subjected to a scaling process or a gradation process by the control portion 60 is stored in a predetermined region.

Figures 8, 9:
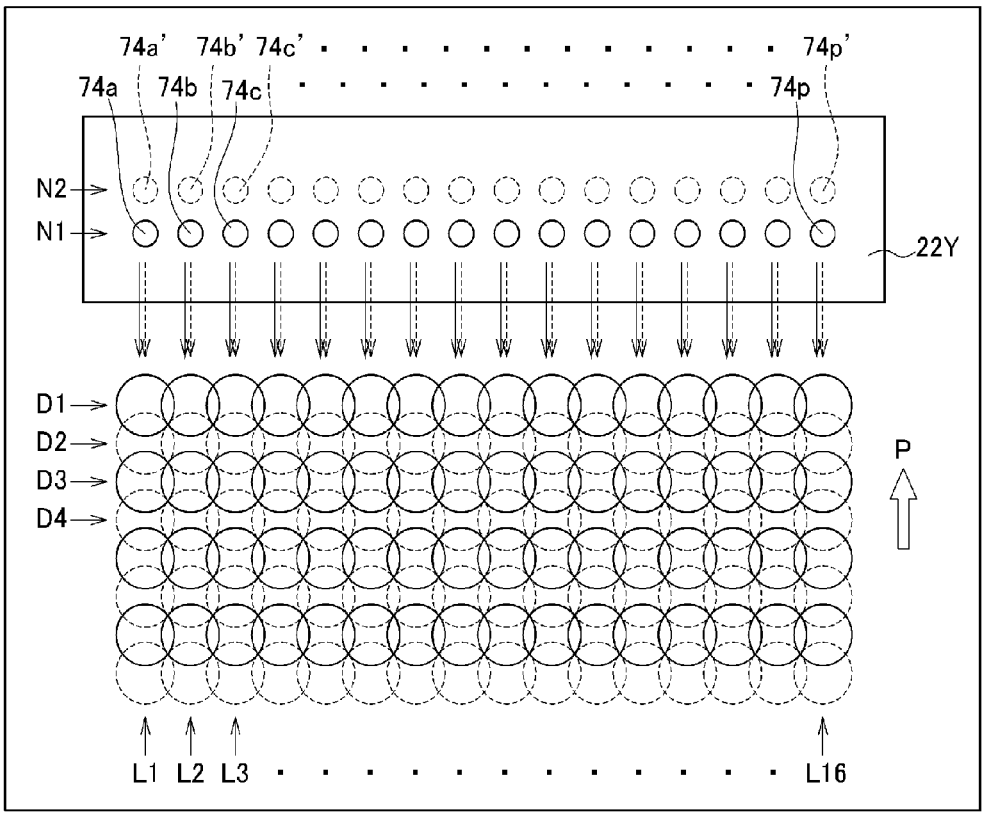
FIG. 8 shows a table that represents a relationship between a temperature and the number of times a piezoelectric element is vibrated.
FIG. 9 illustrates nozzle arrays of the line head.

Further, as shown in FIG. 8, in the ROM 62, the table 500 representing a relationship between temperatures and the number of times the piezoelectric element 72 is to be vibrated (the number of times flushing is performed), is stored. In the table 500 stored in the ROM 62, temperature ranges and the number of times the piezoelectric element 72 is vibrated (the number of times flushing is performed) are stored so as to associate each temperature range with the corresponding number of times the piezoelectric element 72 is vibrated. In the present embodiment, in the table 500, information indicating that the number of times of the vibrations is S1 (times) in the case of a low temperature (higher than or equal to T1 and less than T2), the number of times of the vibrations is S2 (times) in the case of an intermediate temperature (higher than or equal to T2 and less than T3), and the number of times of the vibrations is S3 (times) in the case of a high temperature (higher than or equal to T3), is stored.

The temperature satisfies 0° C.<T1° C.<T2° C.<T3° C. Further, the number of times of vibrations satisfies SX>S1>S2>S3>0. SX represents the number of times by which ejection of the ink W from the nozzle 74 does not occur.

Further, the control portion 60 described above may set, for example, S2 as a standard value of the number of times of vibrations in the non-printing period. In this case, when a temperature obtained by the temperature sensor 70 is low or high, the control portion 60 changes the number of times the piezoelectric element 72 is vibrated and causes the line head control circuit 66 to output a vibration driving voltage by which the piezoelectric element 72 is vibrated the number of times having been changed.

The encoder 64 is connected to the belt drive roller 32 which is disposed on the sheet discharge side and drives the conveyor belt 31, and outputs a train of pulses according to rotational displacement of a rotation shaft of the belt drive roller 32. The control portion 60 counts the pulses transmitted from the encoder 64 to calculate the number of rotations, thereby obtaining a recording paper feed rate (sheet position). The control portion 60 outputs control signals to the motor control circuit 65 and the line head control circuit 66 based on a signal from the encoder 64.

The motor control circuit 65 drives a recording paper conveyance motor 68 according to an output signal from the control portion 60. The motor control circuit 65 drives the recording paper conveyance motor 68 to rotate the belt drive roller 32, thereby rotating the conveyor belt 31 counterclockwise in FIG. 1 and FIG. 3. Thus, the recording paper is conveyed in the sheet conveying direction.

The line head control circuit 66 (application portion) transfers image data stored in the RAM 63 to the line heads 22K to 22Y according to a control signal from the control portion 60, and controls ejection of the inks from the line heads 22K to 22Y based on the transferred image data. Through this control and a control of conveying the recording paper by the conveyor belt 31 driven by the recording paper conveyance motor 68, a process of recording on the recording paper is performed.

Further, the line head control circuit 66 outputs a vibration driving voltage to the piezoelectric elements 72, based on a vibration driving signal from the control portion 60. The line head control circuit 66 vibrates the piezoelectric element 72 to control meniscus vibration in the meniscus M of each of the line heads 22K to 22Y.

The line head control circuit 66 applies a vibration driving voltage to the piezoelectric element 72, based on a vibration driving signal received from the control portion 60. The line head control circuit 66 applies, to the piezoelectric element 72, a vibration driving voltage by which the piezoelectric element 72 is vibrated a predetermined number of times, based on information about the number of times of vibrations which is contained in the vibration driving signal having been received.

Further, when receiving, from the control portion 60, a vibration driving signal representing the number of times of vibrations having been changed, the line head control circuit 66 outputs, to the piezoelectric element 72, a vibration driving voltage by which the piezoelectric element 72 is vibrated the number of times having been changed.

The voltage control circuit 67 generates an alternating electric field by applying a voltage to the follower roller 33 on the sheet feed side, based on an output signal from the control portion 60, thereby electrostatically attaching the recording paper to the conveyor belt 31. The electrostatic attaching can be cancelled by the follower roller 33 or the belt drive roller 32 being grounded based on an output signal from the control portion 60. In the description herein, a voltage is applied to the follower roller 33 on the sheet feed side. However, a voltage may be applied to the belt drive roller 32 on the sheet discharge side.

The humidity sensor 69 (ambient condition obtaining portion) obtains a humidity condition (humidity information). The humidity sensor 69 is disposed, for example, in the vicinity of the recording portion 20. The humidity sensor 69 measures an ambient humidity near the recording portion 20. The temperature sensor 70 (ambient condition obtaining portion) obtains a temperature condition (temperature information). The temperature sensor 70 is disposed in the vicinity of the recording portion 20, and measures an ambient temperature near the recording portion 20. In the present embodiment, the humidity sensor 69 and the temperature sensor 70 are allowed to obtain ambient conditions (humidity, temperature) for the vicinity of the line head 22. The humidity sensor 69 and the temperature sensor 70 output, to the control portion 60, the humidity information and the temperature information having been obtained.

Subsequently, with reference to FIG. 9, a dotting operation performed by the inkjet recording apparatus 1 will be described. Among the line heads 22K to 22Y, the line head 22Y will be described as an example. The description for the other line heads 22K to 22M is exactly the same as that for the line head 22Y.

As shown in FIG. 9, in the line head 22Y, nozzle arrays N1 and N2 each including a plurality of nozzles are aligned in the sheet conveying direction P. Namely, the line head 22Y includes, as a nozzle for forming one dot sequence in the sheet conveying direction P, one nozzle in each of the nozzle arrays N1 and N2 (for example, nozzles 74*a* and 74*a*' for a dot sequence L1), that is, two nozzles in total. For the convenience of description, among nozzles for forming the nozzle arrays N1 and N2, nozzles 74*a* to 74*p* and 74*a*' to 74*p*' corresponding to the dot sequences L1 to L16, that is, 16 nozzles in each nozzle array, are illustrated. However, in practice, the number of nozzles aligned in a direction orthogonal to the sheet conveying direction P is greater than the number described above.

In the inkjet recording apparatus 1, the nozzle arrays N1 and N2 are sequentially used to form an image on a recording medium. For example, while the recording medium is conveyed in the sheet conveying direction P, a dot sequence D1 corresponding to one line, in the width direction (the right-left direction in the drawings), on the recording medium is formed by ink ejection (solid arrow in the drawings) from the nozzle array N1, and a dot sequence D2 corresponding to the immediately following one line is then formed by ink ejection (dashed arrow in the drawings) from the nozzle array N2, and a dot sequence D3 corresponding to one line immediately following the dot sequence D2 is then formed again by ink ejection from the nozzle array N1. Thereafter, the nozzle arrays N1 and N2 are alternately used also for and after a dot sequence D4, to similarly form dot sequences.

Figure 10:
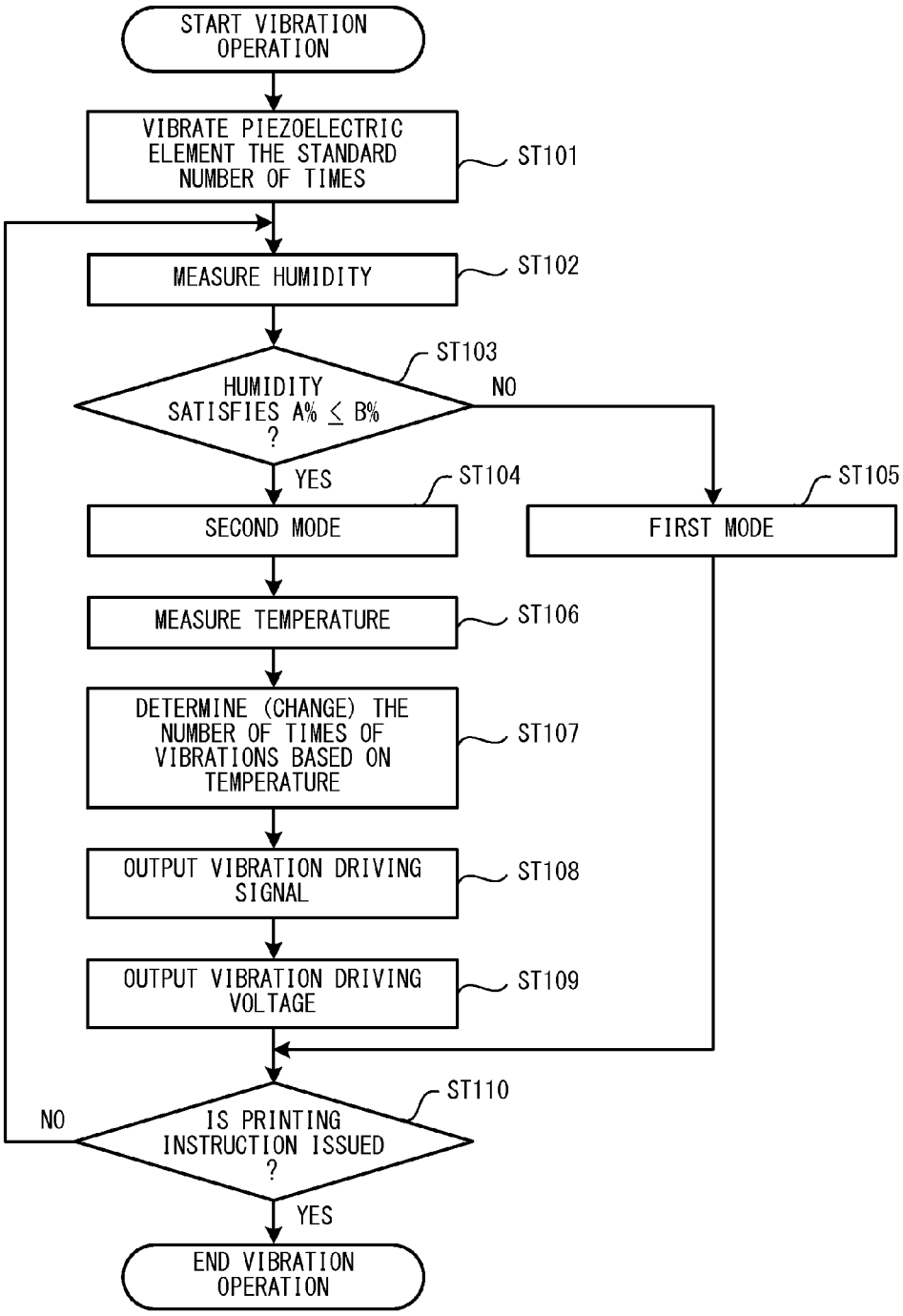
FIG. 10 is a flow chart showing a meniscus vibration operation performed by the inkjet recording apparatus of the first embodiment.

Subsequently, with reference to FIG. 10, a meniscus vibration operation in the ink W performed by the inkjet recording apparatus 1 of the first embodiment will be described.

Firstly, in step ST101, the inkjet recording apparatus 1 (the control portion 60) vibrates the piezoelectric element 72 the number of times which is set for a normal vibration operation. The inkjet recording apparatus 1 (the control portion 60) vibrates the piezoelectric element 72 the number of times per unit time, which is set for the normal vibration operation, for a predetermined vibration period which is set for the normal vibration operation.

Subsequently, in step ST102, the inkjet recording apparatus 1 (the humidity sensor 69) measures a humidity.

Subsequently, in step ST103, the inkjet recording apparatus 1 (the control portion 60) determines whether or not a measured humidity A (%) is less than or equal to a predetermined humidity B (%). When the inkjet recording apparatus 1 (the control portion 60) determines that the humidity A (%) is less than or equal to the predetermined humidity B (%) (step ST103, YES), the process is advanced to step ST104. On the other hand, when the inkjet recording apparatus 1 (the control portion 60) determines that the humidity A (%) is higher than the predetermined humidity B (%) (step ST103, NO), the process is advanced to step ST105.

Subsequently, in step ST104, the inkjet recording apparatus 1 (the control portion 60) switches a mode for the control portion 60 to the second mode. In the inkjet recording apparatus 1, the process is advanced to step ST106.

On the other hand, in step ST105, the inkjet recording apparatus 1 (the control portion 60) switches a mode for the control portion 60 to the first mode. In the inkjet recording apparatus 1, the process is advanced so as to be prior to step ST110.

Subsequently, in step ST106, the inkjet recording apparatus 1 (the temperature sensor 70) measures a temperature.

Subsequently, in step ST107, the inkjet recording apparatus 1 (the control portion 60) sets (changes) the number of times the piezoelectric element 72 is vibrated, based on the measured temperature. For example, the inkjet recording apparatus 1 (the control portion 60) sets (changes), with reference to the table 500, the number of times the piezoelectric element 72 is vibrated.

Subsequently, in step ST108, the inkjet recording apparatus 1 (the control portion 60) outputs, to the line head control circuit 66, a vibration driving signal containing information about the number of times of vibrations having been set (changed).

Subsequently, in step ST109, the inkjet recording apparatus 1 (the line head control circuit 66) outputs, to the piezoelectric element 72, a vibration driving voltage so as to vibrate the piezoelectric element 72 the number of times that has been set (changed) based on the information contained in the vibration driving signal.

Subsequently, in step ST110, the inkjet recording apparatus 1 (the control portion 60) determines whether or not a printing instruction has been issued. When no printing instruction is issued (step ST110, NO), the process is returned so as to be prior to step ST102 by the inkjet recording apparatus 1 (the control portion 60). When a printing instruction is issued (step ST110, YES), the inkjet recording apparatus 1 (the control portion 60) ends the vibration operation.

Thus, the inkjet recording apparatus 1 of the present embodiment can suppress reduction in ejection of ink droplets from nozzles.

Further, the inkjet recording apparatus 1 reduces vibration of the meniscus under a high temperature environment, and increases vibration of the meniscus under a low temperature environment. Thus, the inkjet recording apparatus 1 can suppress entry of air into nozzles due to vibration under a high temperature environment, thereby suppressing reduction in ejection from the nozzles 74.

Further, the inkjet recording apparatus 1 changes the number of times the piezoelectric element is vibrated, based on a temperature that greatly affects ejection of ink. Thus, reduction in ejection from the nozzles can be more advantageously suppressed.

Further, according to the present embodiment, the control portion 60 causes the line head control circuit 66 to output a vibration driving voltage by which the number of times the piezoelectric element 72 is vibrated in the non-printing period is less than or equal to 2000. Thus, the inkjet recording apparatus 1 is allowed to more advantageously suppress reduction in ejection from the nozzles.

Further, according to the present embodiment, the control portion 60 can switch between the first mode and the second mode.

Thus, the inkjet recording apparatus 1 can be configured such that, for example, the number of times the piezoelectric element is vibrated is not changed under a high humidity environment, and the number of times the piezoelectric element is vibrated can be changed according to a temperature under a low humidity environment. Thus, in the inkjet recording apparatus 1, the piezoelectric element is vibrated the standard number of times under a high humidity environment where ejection from the nozzles is less likely to be reduced, whereas the number of times the piezoelectric element is vibrated is changed according to a temperature in order to minutely address a situation under a low humidity environment where ejection from the nozzles is likely to be reduced. Thus, in the inkjet recording apparatus 1, reduction in ejection from the nozzles can be more advantageously suppressed.

Subsequently, with reference to FIG. 11 to FIG. 15, an inkjet recording apparatus according to a second embodiment will be described.

Hereinafter, difference from the inkjet recording apparatus of the first embodiment will be mainly described. Description of components common to those of the first embodiment is not given. For components that are not described in the second embodiment, description for the first embodiment is to be referred to.

An inkjet recording apparatus 1A of the second embodiment is different from the inkjet recording apparatus 1 of the first embodiment in that, in the inkjet recording apparatus 1A, the number of times the piezoelectric element 72 is vibrated is changed based on a zero shear viscosity in ink.

In non-Newtonian fluid such as ink, since a relationship between shear rates and viscosities is not a proportional relationship, it is difficult to make a comparison in physical properties of ink based on values of shear viscosities. Therefore, in the present embodiment, in the inkjet recording apparatus 1A, the number of times the piezoelectric element 72 is vibrated (the number of times flushing is performed) is changed based on a zero shear viscosity.

A zero shear viscosity of ink cannot be directly measured. For example, a zero shear viscosity of ink is measured by using a rolling ball type viscometer. Specifically, a tilt angle θ (see, for example, FIG. 13) is changed at predetermined angular intervals to make a measurement, and a viscosity at a predetermined angle is measured. When the horizontal axis represents values of sin θ and the vertical axis represents shear viscosities, a value at sin θ=0 (θ=0) in a sin θ-viscosity curve obtained by plotting the values of sin θ and the shear viscosities against each other is calculated as the zero shear viscosity.

Figure 13:
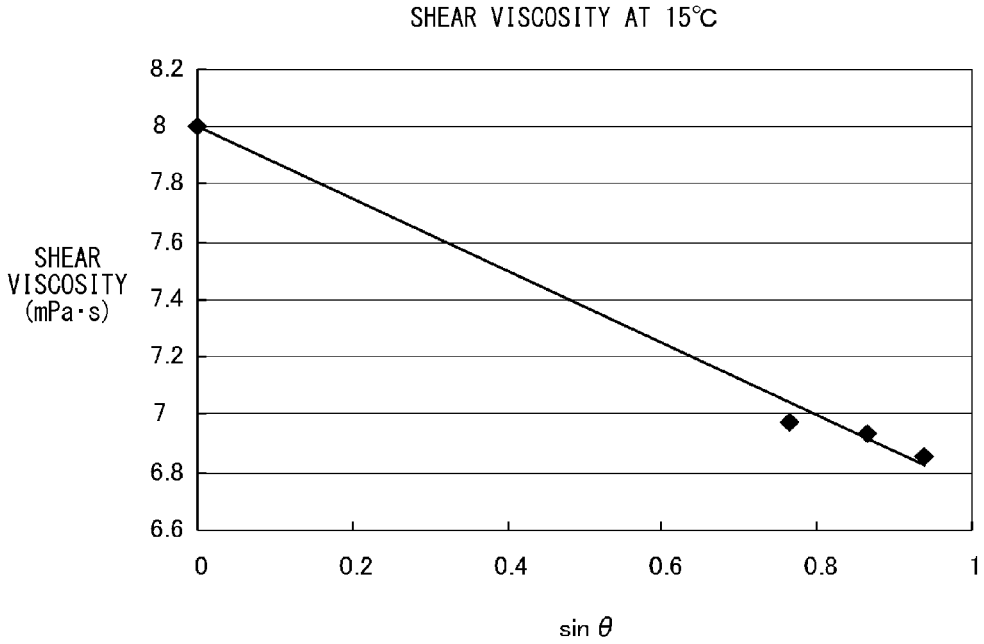
FIG. 13 shows a relationship at 15° C. between shear viscosities and values of sin 0.

FIG. 13 shows a relationship at 15° C. between shear viscosities and values of sin θ. Zero shear viscosities at various temperatures are obtained in the same manner as described above to obtain a graph indicated in FIG. 14. A relationship between temperatures and zero shear viscosities as shown in FIG. 12 is obtained based on the graph indicated in FIG. 14.

Figure 11:
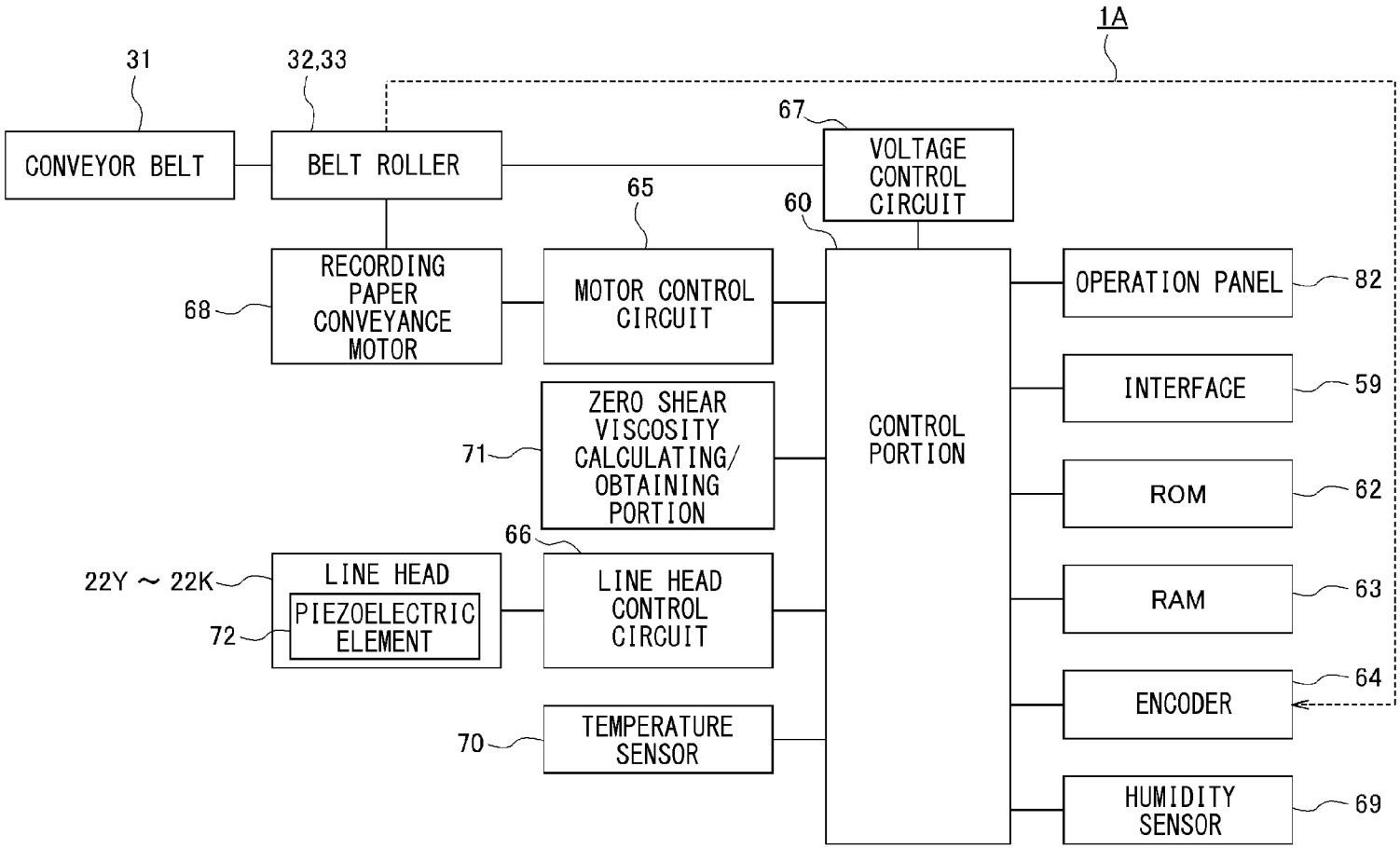
FIG. 11 is a block diagram illustrating a configuration of an inkjet recording apparatus according to a second embodiment.

As shown in FIG. 11, the inkjet recording apparatus 1A includes a zero shear viscosity calculating/obtaining portion 71 in addition to the components of the inkjet recording apparatus 1 of the first embodiment. Based on a temperature measured by the temperature sensor 70, the zero shear viscosity calculating/obtaining portion 71 calculates a zero shear viscosity by using, for example, a predetermined expression, a graph, or a program, or obtains a zero shear viscosity from, for example, a table 500A stored in the ROM 62.

Figure 14:
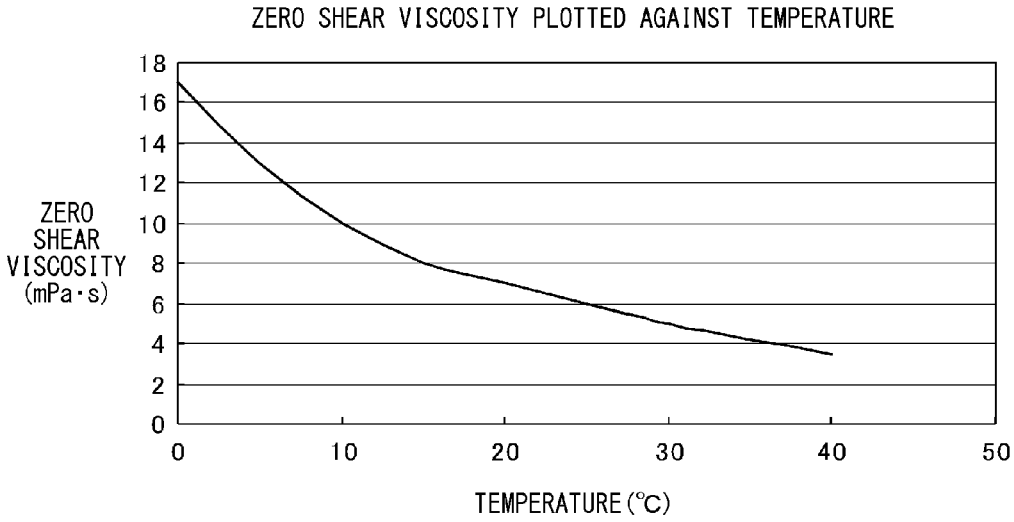
FIG. 14 shows a graph that represents zero shear viscosities plotted against temperatures.

When calculating the zero shear viscosity, the zero shear viscosity calculating/obtaining portion 71 calculates the zero shear viscosity at a predetermined temperature according to, for example, the graph indicated in FIG. 14. Further, as described above, the zero shear viscosity calculating/obtaining portion 71 may calculate the zero shear viscosity at a predetermined temperature according to a predetermined expression. Furthermore, the zero shear viscosity calculating/obtaining portion 71 may calculate the zero shear viscosity at a predetermined temperature by using a predetermined program.

Further, when obtaining the zero shear viscosity, the zero shear viscosity calculating/obtaining portion 71 obtains the zero shear viscosity at a predetermined temperature according to, for example, the table 500A indicated in FIG. 12. The ROM 62 is a storage portion for storing zero shear viscosities of the ink W ejected from the nozzles 74, and storing the table 500A in which predetermined temperatures and zero shear viscosities are stored so as to associate each temperature with the corresponding zero shear viscosity.

Further, in the present embodiment, the control portion 60 changes the number of times the piezoelectric element 72 is vibrated in the non-printing period, based on the zero shear viscosity calculated or obtained by the zero shear viscosity calculating/obtaining portion 71, and causes the line head control circuit 66 to output a vibration driving voltage by which the piezoelectric element 72 is vibrated the number of times having been changed. The control portion 60 changes the number of times the piezoelectric element 72 is vibrated in the non-printing period, based on not a temperature but the zero shear viscosity calculated or obtained according to a temperature. The control portion 60 causes the line head control circuit 66 to output a vibration driving voltage by which the piezoelectric element 72 is vibrated the number of times having been changed.

Further, in the present embodiment, the control portion 60 causes the line head control circuit 66 to output a vibration driving voltage by which the number of times the piezoelectric element 72 is vibrated in the non-printing period is as follows. That is, the number of times the piezoelectric element 72 is vibrated in the non-printing period is less than or equal to 500, and preferably greater than or equal to 400 and not greater than 500, in the case of the zero shear viscosity being less than or equal to 5.0 mPa·s. Furthermore, the number of times the piezoelectric element 72 is vibrated in the non-printing period ranges from 500 to 1000 in the case of the zero shear viscosity being higher than 5.0 mPa·s and less than 9.0 mPa·s. Moreover, the number of times the piezoelectric element 72 is vibrated in the non-printing period is greater than or equal to 1000, and preferably greater than or equal to 1000 and not greater than 1200 in the case of the zero shear viscosity being higher than or equal to 9.0 mPa·s. The control portion 60 vibrates the piezoelectric element 72 under advantageous conditions according to the zero shear viscosity.

Further, as in the first embodiment, the control portion 60 executes a first mode and a second mode, and can change (shift) a mode to one of the first mode and the second mode. Specifically, in the first mode, the control portion 60 changes the number of times the piezoelectric element 72 is vibrated in the non-printing period, based on a humidity measured by the humidity sensor 69, and the control portion 60 does not cause the line head control circuit 66 to output a vibration driving voltage by which the piezoelectric element 72 is vibrated the number of times having been changed. In the second mode, the control portion 60 changes the number of times the piezoelectric element 72 is vibrated in the non-printing period, based on a humidity measured by the humidity sensor 69, and the control portion 60 causes the line head control circuit 66 to output a vibration driving voltage by which the piezoelectric element 72 is vibrated the number of times having been changed. The control portion 60 can change a mode to one of the first mode and the second mode, based on a humidity measured by the humidity sensor 69.

Figure 15:
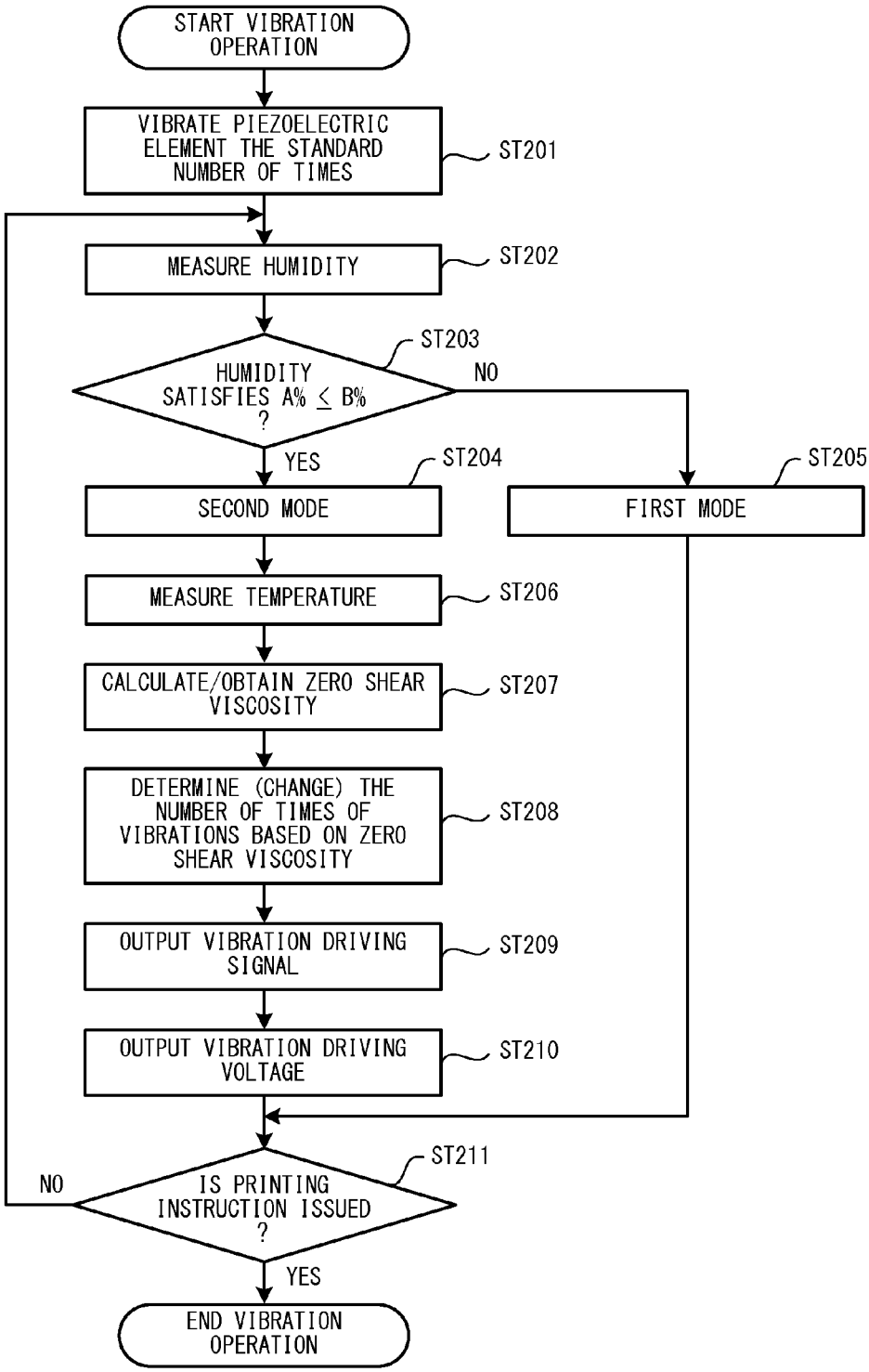
FIG. 15 is a flow chart illustrating a meniscus vibration operation performed by the inkjet recording apparatus of the second embodiment.

Subsequently, with reference to FIG. 15, a meniscus vibration operation in the ink W performed by the inkjet recording apparatus 1A of the second embodiment will be described.

Firstly, in step ST201, the inkjet recording apparatus 1A (the control portion 60) vibrates the piezoelectric element 72 the number of times which is set for a normal vibration operation. The inkjet recording apparatus 1A (the control portion 60) vibrates the piezoelectric element 72 the number of times per unit time, which is set for the normal vibration operation, for a predetermined vibration period which is set for the normal vibration operation.

Subsequently, in step ST202, the inkjet recording apparatus 1A (the humidity sensor 69) measures a humidity.

Subsequently, in step ST203, the inkjet recording apparatus 1A (the control portion 60) determines whether or not a measured humidity A (%) is less than or equal to a predetermined humidity B (%). When the inkjet recording apparatus 1A (the control portion 60) determines that the humidity A (%) is less than or equal to the predetermined humidity B (%) (step ST203, YES), the process is advanced to step ST204. On the other hand, when the inkjet recording apparatus 1A (the control portion 60) determines that the humidity A (%) is higher than the predetermined humidity B (%) (step ST203, NO), the process is advanced to step ST205.

Subsequently, in step ST204, the inkjet recording apparatus 1A (the control portion 60) switches a mode for the control portion 60 to the second mode. In the inkjet recording apparatus 1A, the process is advanced to step ST206.

On the other hand, in step ST205, the inkjet recording apparatus 1A (the control portion 60) switches a mode for the control portion 60 to the first mode. In the inkjet recording apparatus 1A, the process is advanced so as to be prior to step ST211.

Subsequently, in step ST206, the inkjet recording apparatus 1A (the temperature sensor 70) measures a temperature.

Subsequently, in step ST207, the inkjet recording apparatus 1A (the zero shear viscosity calculating/obtaining portion 71) calculates or obtains a zero shear viscosity based on the temperature.

Subsequently, in step ST208, the inkjet recording apparatus 1A (the control portion 60) sets (changes) the number of times the piezoelectric element 72 is vibrated, based on the calculated or obtained zero shear viscosity. For example, the inkjet recording apparatus 1A (the control portion 60) sets (changes), with reference to the table 500A, the number of times the piezoelectric element 72 is vibrated.

Subsequently, in step ST209, the inkjet recording apparatus 1A (the control portion 60) outputs, to the line head control circuit 66, a vibration driving signal containing information about the number of times of vibrations having been set (changed).

Subsequently, in step ST210, the inkjet recording apparatus 1A (the line head control circuit 66) outputs, to the piezoelectric element 72, a vibration driving voltage so as to vibrate the piezoelectric element 72 the number of times that has been set (changed) based on the information contained in the vibration driving signal.

Subsequently, in step ST211, the inkjet recording apparatus 1A (the control portion 60) determines whether or not a printing instruction has been issued. When no printing instruction is issued (step ST211, NO), the process is returned so as to be prior to step ST202 by the inkjet recording apparatus 1A (the control portion 60).

When a printing instruction is issued (step ST211, YES), the inkjet recording apparatus 1A (the control portion 60) ends the vibration operation.

Thus, the inkjet recording apparatus 1A of the present embodiment can suppress reduction in ejection of ink droplets from nozzles.

Further, the inkjet recording apparatus 1A changes the number of times the piezoelectric element is vibrated, according to a state of ink. Thus, the inkjet recording apparatus 1A is allowed to advantageously suppress reduction in ejection from the nozzles 74.

Further, the inkjet recording apparatus 1A reduces vibration of a meniscus in ink having a low zero shear viscosity, and increases vibration of a meniscus in ink having a high zero shear viscosity. Thus, the inkjet recording apparatus 1A suppresses reduction in ejection from the nozzles 74.

Further, the inkjet recording apparatus 1A can suppress entry of air into the nozzles 74, which occurs due to vibration of a meniscus in ink having a low zero shear viscosity. Thus, the inkjet recording apparatus 1A can suppress reduction in ejection from the nozzles.

Further, the inkjet recording apparatus 1A changes the number of times the piezoelectric element is vibrated, based on a zero shear viscosity that greatly affects ejection of ink. Thus, reduction in ejection from the nozzles can be more advantageously suppressed.

Further, according to the present embodiment, the control portion 60 causes the line head control circuit 66 to output a vibration driving voltage by which the number of times the piezoelectric element 72 is vibrated is less than or equal to 500 in the case of a zero shear viscosity being less than or equal to 5.0 mPa·s, the number of times the piezoelectric element 72 is vibrated ranges from 500 to 1000 in the case of a zero shear viscosity being higher than 5.0 mPa·s and less than 9.0 mPa·s, and the number of times the piezoelectric element 72 is vibrated is greater than or equal to 1000 in the case of a zero shear viscosity being higher than or equal to 9.0 mPa·s. The control portion 60 vibrates the piezoelectric element 72 under advantageous conditions according to the zero shear viscosity. Thus, the inkjet recording apparatus 1A can more advantageously suppress reduction in ejection from the nozzles.

Further, according to the present embodiment, the control portion 60 can change a mode to one of the first mode and the second mode. Thus, the inkjet recording apparatus 1A can be configured such that, for example, the number of times the piezoelectric element is vibrated is not changed under a high humidity environment, and the number of times the piezoelectric element is vibrated can be changed according to a temperature under a low humidity environment. Thus, in the inkjet recording apparatus 1A, the piezoelectric element is vibrated the standard number of times under a high humidity environment where ejection from the nozzles is less likely to be reduced, whereas the number of times the piezoelectric element is vibrated is changed according to a temperature in order to minutely address a situation under a low humidity environment where ejection from the nozzles is likely to be reduced. Thus, in the inkjet recording apparatus 1A, reduction in ejection from the nozzles can be more advantageously suppressed.

Subsequently, the number of times the piezoelectric element is vibrated will be further described.

According to the above description, in the inkjet recording apparatus, it is preferable that, for example, the number of times the piezoelectric element is vibrated is less than or equal to 500 in the case of a zero shear viscosity being less than or equal to 5.0 mPa·s, the number of times the piezoelectric element is vibrated ranges from 500 to 1000 in the case of a zero shear viscosity being higher than 5.0 mPa·s and less than 9.0 mPa·s, and the number of times the piezoelectric element is vibrated is greater than or equal to 1000 in the case of a zero shear viscosity being higher than or equal to 9.0 mPa·s. The grounds for the values that are determined as above will be described below.

Ink for use in the inkjet recording apparatus was evaluated for variation in landing, concentration, and satellite droplets under environments where the zero shear viscosities were 4 mPa·s, 5 mPa·s, 9 mPa·s, and 10 mPa·s, and it was confirmed that the values described above were appropriate. A composition of ink and an ink production method, an evaluation method, and evaluation results are indicated below.

<Ink>

(Synthesizing of Acrylic Resin)

An acrylic resin will be described below. As a method for synthesizing an acrylic resin, a macromonomer synthesis method was used. The macromonomer synthesis method is a polymerization method executable with ease and stability. An oligomer (Mn=6,000, product name: AS-6, manufactured by Toagosei Kabushiki Kaisha) having a (meth)acryloyl group bonded to one of molecular ends of a polystyrene, was used, and other monomers were added according to a ratio for the resin. The monomers were polymerized in MEK together with a publicly known initiator such as an azo compound like 2, 2'-azobisisobutyronitrile, or 2,2'-azobis(2,4-dimethylvaleronitrile), to obtain an acrylic resin having a molecular weight of 60000. After the reaction, a solvent was distilled under a reduced pressure. Further, as the molecular weight of the obtained resin, a weight average molecular weight was confirmed by using gel filtration chromatography. The acid value was confirmed by titration.

(Dispersion of Pigment)

As a pigment, cyan pigment: P. B-15:3 was used. As a pigment dispersion used in an experiment, a particulate pigment dispersion covered with a resin having a molecular weight of tens of thousands is appropriate in the case of an image quality being required. As a material satisfying the aforementioned conditions, a styrene acrylic resin is appropriate, that is, a resin having an acid value ranging from 150 to 300, is appropriate. (When an acid value is low, dispersion of pigments is poor, it is difficult to form fine particles, and color development property and coloring property are poor. On the other hand, when an acid value is high, ink storage stability is poor). In addition, various materials were blended according to the aforementioned composition, and kneading was performed by means of a media type dispersing machine. As a dispersing machine, a wet-type dispersing machine (NANO GRAIN MILL: manufactured by Asada Tekko Kabushiki Kaisha) was used.

Conditions for the dispersion were as follows. That is, beads each having a small diameter (0.5 mm·1.0 mm zirconia beads) were set in a vessel, and the pigment dispersion was dispersed such that a particle size was adjusted so as to have an average particle diameter ranging from 70 nm to 130 nm. Further, a bead type was changed to change a degree of dispersion and an amount of free resin. Needless to say, when a bead diameter is reduced, fine particles are easily formed and covering of pigments with a resin is enhanced.

A particle size distribution was measured with a solution obtained by 300-fold dilution with ion-exchanged water, by using Zetasizer (registered trademark) nano (manufactured by SYSMEX CORPORATION) as a measurement device.

Blending of the pigment dispersion is as indicated in Table 1. Blending of ink is as indicated in Table 2.

TABLE 1

(Blending of pigment dispersion)

| | wt % |
|---|---|
| Water | 80 |
| Resin | 5.0 |
| Pigment | 15 |
| Olefin E1010 | 0.5 |
| Total | 100.0 |

In Table 1, a ratio of an amount of the resin to an amount of the pigment may be optionally changed. The resin is soluble in water (alkali-soluble resin), and is neutralized with an equivalent of KOH.

TABLE 2

(Ink production method)

| Material | wt % |
|---|---|
| Pigment dispersion (Pig. 15%) | 42 |
| Olefin E1010 | 0.5 |
| Triethyleneglycolmonomethylether | 10.0 |
| 2-pyrrolidone | 5.0 |
| 1,2-octanediol | 0.8 |
| Glycerin | 25 |
| Ion-exchanged water | Remainder |
| Total | 100.0 |

The ink was produced according to the blending indicated in Table 2.

<Evaluation Method>

Ink for use in the inkjet recording apparatus was evaluated for variation in landing, concentration, and satellite droplets under environments where the zero shear viscosities were 4 mPa·s, 5 mPa·s, 9 mPa·s, and 10 mPa·s. Evaluation items and evaluation criterions are as follows.

<Evaluation Item and Evaluation Criterion>

(Variation in Landing)

Inks for an image were simultaneously ejected from all of nozzles (2564 pins) of a 600 dpi head, to print the image under conditions that a speed at which a recording medium was conveyed was 846.7 mm/sec., and a droplet ejection rate was 8 m/s. The printed object was measured by the image processing system device Da-6000 (manufactured by Oji Scientific Instruments). An image was captured and the image was binarized, and image correction was performed. Thereafter, a brightness distribution per one pixel was measured by using Da-6000, averaged, and represented as the second order value.

(Evaluation Criterions)

Excellent: A value (lower limit value) less than 10 μm was obtained as variation in landing.

Average: A value that ranges from 10 μm to 15 μm was obtained as variation in landing.

Poor: A value greater than or equal to 15 μm was obtained as variation in landing.

(Concentration)

Concentrations for printing were measured by using the line head 22C (FIG. 2). For the measurement, an ink ejecting amount was controlled such that an ink impact on a recording medium was 15 g/m$^2$, and a conveying speed was 846.7 mm/sec., thereby printing a solid image. As sheets, a sheet IJW (brand name) manufactured by Oji Paper Co., Ltd. was cut into A4 size sheets and used. An image size was 10 cm×10 cm. The printed image was left as it was all night and all day after the image had been printed, and concentrations for printing were then measured with GretagMacbeth at a view angle of 2° by using a D50 light source.

(Evaluation Criterions)

Excellent: A concentration for printing was higher than or equal to 0.98.

Poor: A concentration for printing was less than 0.98.

(Satellite Droplet Evaluation)

An image was printed on a glossy paper by using a recording head, and a printed state of dots were observed by using a microscope, and evaluated.

(Evaluation Criterions)

Excellent: No satellite droplets occurred.

Poor: Satellite droplets occurred.

<Evaluation Results>

In Table 3 to Table 6, evaluation results for variation in landing are indicated below. In Table 7 to Table 10, evaluation results for concentrations are indicated. In Table 11 to Table 14, evaluation results for satellite droplet are indicated.

TABLE 3

(Variation in landing: 4 mPa)

| | | | | | |
|---|---|---|---|---|---|
| The number of vibrations (the number of times) | 3000 | 2500 | 2000 | 1500 | 1000 |
| Variation in landing | Poor (26 μm) | Poor (25 μm) | Poor (22 μm) | Poor (19 μm) | Poor (17 μm) |
| The number of vibrations (the number of times) | 800 | 600 | 500 | 400 | 300 |
| Variation in landing | Poor | $ó˜ß˚Æ˜# (12 μm) | Excellent (9.0 μm) | Excellent (7.0 μm) | Excellent (6.0 μm) |

TABLE 4

(Variation in landing: 5 mPa)

| | | | | | |
|---|---|---|---|---|---|
| The number of vibrations (the number of times) | 3000 | 2500 | 2000 | 1500 | 1000 |
| Variation in landing | Poor (19 μm) | Poor (18 μm) | Poor (17 μm) | $ó˜ß˚Æ˜# (13 μm) | Excellent (9.0 μm) |
| The number of vibrations (the number of times) | 800 | 600 | 500 | 400 | 300 |
| Variation in landing | Excellent | Excellent (8.0 μm) | Excellent (9.0 μm) | $ó˜ß˚Æ˜# (11 μm) | $ó˜ß˚Æ˜# (14 μm) |

TABLE 5

| (Variation in landing: 9.0 mPa) | | | | | |
|---|---|---|---|---|---|
| The number of vibrations (the number of times) | 3000 | 2500 | 2000 | 1500 | 1000 |
| Variation in landing | Excellent (6 μm) | Excellent (6 μm) | Excellent (6 μm) | Excellent (7 μm) | Excellent (8 μm) |
| The number of vibrations (the number of times) | 800 | 600 | 500 | 400 | 300 |
| Variation in landing | Excellent (7 μm) | Excellent (7 μm) | Excellen (8 μm) | $ó˘ß˚æ˘# (10 μm) | $ó˘ß˚æ˘ (13 μm) |

TABLE 6

| (Variation in landing: 10 mPa) | | | | | |
|---|---|---|---|---|---|
| The number of vibrations (the number of times) | 3000 | 2500 | 2000 | 1500 | 1000 |
| Variation in landing | Excellent (6 μm) | Excellent (6 μm) | Excellent (6 μm) | Excellent (7 μm) | Excellent (9 μm) |
| The number of vibrations (the number of times) | 800 | 600 | 500 | 400 | 300 |
| Variation in landing | $ó˘ß˚æ˘# (12 μm) | $ó˘ß˚æ˘# (14 μm) | Poor (16 μm) | Poor (18 μm) | Poor (21 μm) |

TABLE 7

| (Concentration: 4 mPa) | | | | | |
|---|---|---|---|---|---|
| The number of vibrations (the number of times) | 3000 | 2500 | 2000 | 1500 | 1000 |
| Concentration | Excellent | Excellent | Excellent | Excellent | Excellent |
| The number of vibrations (the number of times) | 800 | 600 | 500 | 400 | 300 |
| Concentration | Excellent | Excellent | Excellent | Excellent | Excellent |

TABLE 8

| (Concentration: 5 mPa) | | | | | |
|---|---|---|---|---|---|
| The number of vibrations (the number of times) | 3000 | 2500 | 2000 | 1500 | 1000 |
| Concentration | Excellent | Excellent | Excellent | Excellent | Excellent |
| The number of vibrations (the number of times) | 800 | 600 | 500 | 400 | 300 |
| Concentration | Excellent | Excellent | Excellent | Excellent | Excellent |

TABLE 9

| (Concentration: 9.0 mPa) | | | | | |
|---|---|---|---|---|---|
| The number of vibrations (the number of times) | 3000 | 2500 | 2000 | 1500 | 1000 |

TABLE 9-continued

| (Concentration: 9.0 mPa) | | | | | |
|---|---|---|---|---|---|
| Concentration | Excellent | Excellent | Excellent | Excellent | Excellent |
| The number of vibrations (the number of times) | 800 | 600 | 500 | 400 | 300 |
| Concentration | Excellent | Excellent | Excellent | Poor | Poor |

TABLE 10

| (Concentration: 10 mPa) | | | | | |
|---|---|---|---|---|---|
| The number of vibrations (the number of times) | 3000 | 2500 | 2000 | 1500 | 1000 |
| Concentration | Excellent | Excellent | Excellent | Excellent | Excellent |
| The number of vibrations (the number of times) | 800 | 600 | 500 | 400 | 300 |
| Concentration | Poor | Poor | Poor | Poor | Poor |

TABLE 11

| (Satellite droplet evaluation: 4 mPa) | | | | | |
|---|---|---|---|---|---|
| The number of vibrations (the number of times) | 3000 | 2500 | 2000 | 1500 | 1000 |
| Satellite droplet evaluation | Poor | Poor | Poor | Poor | Poor |
| The number of vibrations (the number of times) | 800 | 600 | 500 | 400 | 300 |
| Satellite droplet evaluation | Poor | Poor | Excellent | Excellent | Excellent |

TABLE 12

| (Satellite droplet evaluation: 5 mPa) | | | | | |
|---|---|---|---|---|---|
| The number of vibrations (the number of times) | 3000 | 2500 | 2000 | 1500 | 1000 |
| Satellite droplet evaluation | Poor | Poor | Poor | Poor | Excellent |
| The number of vibrations (the number of times) | 800 | 600 | 500 | 400 | 300 |
| Satellite droplet evaluation | Excellent | Excellent | Excellent | Excellent | Excellent |

TABLE 13

| (Satellite droplet evaluation: 9.0 mPa) | | | | | |
|---|---|---|---|---|---|
| The number of vibrations (the number of times) | 3000 | 2500 | 2000 | 1500 | 1000 |
| Satellite droplet evaluation | Excellent | Excellent | Excellent | Excellent | Excellent |
| The number of vibrations (the number of times) | 800 | 600 | 500 | 400 | 300 |
| Satellite droplet evaluation | Excellent | Excellent | Excellent | Excellent | Excellent |

TABLE 14

| (Satellite droplet evaluation: 10 mPa) | | | | | |
|---|---|---|---|---|---|
| The number of vibrations (the number of times) | 3000 | 2500 | 2000 | 1500 | 1000 |
| Satellite droplet evaluation | Excellent | Excellent | Excellent | Excellent | Excellent |
| The number of vibrations (the number of times) | 800 | 600 | 500 | 400 | 300 |
| Satellite droplet evaluation | Excellent | Excellent | Excellent | Excellent | Excellent |

According to the evaluation results indicated above, in the inkjet recording apparatus, it is preferable that the number of times the piezoelectric element is vibrated is less than or equal to 500 in the case of a zero shear viscosity being less than or equal to 5.0 mPa·s, the number of times the piezoelectric element is vibrated ranges from 500 to 1000 in the case of a zero shear viscosity being higher than 5.0 mPa·s and less than 9.0 mPa·s, and the number of times the piezoelectric element is vibrated is greater than or equal to 1000 in the case of a zero shear viscosity being higher than or equal to 9.0 mPa·s.

Preferred embodiments of the present disclosure have been described above. However, the present disclosure is not limited to the above embodiments, and various modifications can be made. For example, in the embodiments, the inkjet recording apparatus (printer) for color printing is described as an inkjet recording apparatus. The present disclosure is not limited thereto. The inkjet recording apparatus may be implemented as, for example, black-and-white printers, black-and-white copying machines, color copying machines, facsimile machines, or multifunctional peripherals having the entirety or some of functions of the printers and machines.

Further, a sheet-like recording medium is not limited to a paper T, and may be, for example, a film sheet.

Further, a recording mode of the inkjet recording apparatus is not limited to any specific recording mode. A serial mode in which a line head performs recording while scanning the recording paper T as a recording medium may be used, or a line head mode in which a line head fixed to an apparatus body performs recording may be used. In the viewpoint of high speed image forming, a line head mode is advantageous.

Further, in the embodiments, the control portion changes the number of times of the vibrations by changing a vibration period. However, the present disclosure is not limited thereto. The number of times of vibrations may be changed by changing the number of times of vibrations per unit time.

It is to be understood that the embodiments herein are illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

The invention claimed is:

1. An inkjet recording apparatus comprising:

a plurality of nozzles each of which can eject ink droplets toward a recording medium, and configured to have a meniscus of ink formed therein;

pressurizing chambers that communicate with the plurality of nozzles, respectively, and into which ink is charged;

a piezoelectric element that is deformed by a driving voltage being applied, and operates to eject the ink having been charged into the pressurizing chambers, as ink droplets, from the nozzles;

an ambient condition obtaining portion that can obtain an ambient condition;

an application portion that applies the driving voltage to the piezoelectric element; and a control portion that causes the application portion to output an ejection driving voltage by which the piezoelectric element is deformed so as to eject droplets from the nozzles in a printing period in a printing state, and that causes the application portion to output a vibration driving voltage by which the piezoelectric element is vibrated a predetermined number of times so as to vibrate a meniscus in each nozzle in a non-printing period between printing periods in the printing state, wherein the control portion changes the number of times the piezoelectric element is vibrated in the non-printing period, based on the ambient condition obtained by the ambient condition obtaining portion and causes the application portion to output a vibration driving voltage by which the piezoelectric element is vibrated the number of times having been changed, the ambient condition obtaining portion can obtain a humidity condition, the control portion executes:

a first mode in which the control portion changes the number of times the piezoelectric element is vibrated in the non-printing period, based on the ambient condition obtained by the ambient condition obtaining portion, and the control portion does not cause the application portion to output the vibration driving voltage by which the piezoelectric element is vibrated the changed number of times, and a second mode in which the control portion changes the number of times the piezoelectric element is vibrated in the non-printing period, based on the ambient condition obtained by the ambient condition obtaining portion, and the control portion causes the application portion to output the vibration driving voltage by which the piezoelectric element is vibrated the changed number of times, and the control portion can switch between the first mode and the second mode, based on the humidity condition obtained by the ambient condition obtaining portion.

2. The inkjet recording apparatus according to claim 1, wherein the control portion changes the number of times the piezoelectric element is vibrated by changing a vibration period during which the piezoelectric element is vibrated, and causes the application portion to output a vibration driving voltage by which the piezoelectric element is vibrated the number of times having been changed.

3. The inkjet recording apparatus according to claim 2, wherein the control portion causes the application portion to output the vibration driving voltage by which the number of times the piezoelectric element is vibrated in the non-printing period is less than or equal to 2000.

4. The inkjet recording apparatus according to claim 1, wherein the control portion causes the application portion to output the vibration driving voltage by which the number of times the piezoelectric element is vibrated in the non-printing period is less than or equal to 2000.

5. An inkjet recording apparatus comprising:

a plurality of nozzles each of which can eject ink droplets toward a recording medium, and configured to have a meniscus of ink formed therein;

pressurizing chambers that communicate with the plurality of nozzles, respectively, and into which ink is charged;

a piezoelectric element that is deformed by a driving voltage being applied, and operates to eject the ink having been charged into the pressurizing chambers, as ink droplets, from the nozzles;

an ambient condition obtaining portion that can obtain an ambient condition;

an application portion that applies the driving voltage to the piezoelectric element; and a control portion that causes the application portion to output an ejection driving voltage by which the piezoelectric element is deformed so as to eject droplets from the nozzles in a printing period in a printing state, and that causes the application portion to output a vibration driving voltage by which the piezoelectric element is vibrated a predetermined number of times so as to vibrate a meniscus in each nozzle in a non-printing period between printing periods in the printing state, wherein the control portion changes the number of times the piezoelectric element is vibrated in the non-printing period, based on the ambient condition obtained by the ambient condition obtaining portion, and causes the application portion to output a vibration driving voltage by which the piezoelectric element is vibrated the number of times, per unit time, which has been changed, the ambient condition obtaining portion can obtain a humidity condition, the control portion executes:

a first mode in which the control portion chances the number of times the piezoelectric element is vibrated in the non-printing period, based on the ambient condition obtained by the ambient condition obtaining portion, and the control portion does not cause the application portion to output the vibration driving voltage by which the piezoelectric element is vibrated the changed number of times, and a second mode in which the control portion changes the number of times the piezoelectric element is vibrated in the non-printing period, based on the ambient condition obtained by the ambient condition obtaining portion, and the control portion causes the application portion to output the vibration driving voltage by which the piezoelectric element is vibrated the changed number of times, and the control portion can switch between the first mode and the second mode, based on the humidity condition obtained by the ambient condition obtaining portion.

6. The inkjet recording apparatus according to claim 5, wherein the ambient condition obtaining portion obtains a temperature condition, and the control portion changes the number of times the piezoelectric element is vibrated in the non-printing period, based on the temperature condition obtained by the ambient condition obtaining portion, and causes the application portion to output a vibration driving voltage by which the piezoelectric element is vibrated the number of times having been changed.

7. The inkjet recording apparatus according to claim 5, wherein the control portion changes the number of times the piezoelectric element is vibrated by changing a vibration period during which the piezoelectric element is vibrated, and causes the application portion to output the vibration driving voltage by which the piezoelectric element is vibrated the number of times having been changed.

8. The inkjet recording apparatus according to claim 7, wherein the control portion causes the application portion to output the vibration driving voltage by which the number of times the piezoelectric element is vibrated in the non-printing period is less than or equal to 2000.

9. The inkjet recording apparatus according to claim 5, wherein the control portion causes the application portion to output the vibration driving voltage by which the number of times the piezoelectric element is vibrated in the non-printing period is less than or equal to 2000.

10. An inkjet recording apparatus comprising:

a plurality of nozzles each of which can eject ink droplets toward a recording medium, and configured to have a meniscus of ink formed therein;

pressurizing chambers that communicate with the plurality of nozzles, respectively, and into which ink is charged;

a piezoelectric element that is deformed by a driving voltage being applied, and operates to eject the ink having been charged into the pressurizing chambers, as ink droplets, from the nozzles;

an ambient condition obtaining portion that can obtain an ambient condition;

an application portion that applies the driving voltage to the piezoelectric element;

a zero shear viscosity calculating/obtaining portion that calculates or obtains a zero shear viscosity of ink, based on the ambient condition obtained by the ambient condition obtaining portion, and a control portion that causes the application portion to output an ejection driving voltage by which the piezoelectric element is deformed so as to eject droplets from the nozzles in a printing period in a printing state, and that causes the application portion to output a vibration driving voltage by which the piezoelectric element is vibrated a predetermined number of times so as to vibrate the meniscus in each nozzle in a non-printing period between printing periods in the printing state, wherein the control portion changes the number of times the piezoelectric element is vibrated in the non-printing period, based on the zero shear viscosity calculated or obtained by the zero shear viscosity calculating/obtaining portion, and causes the application portion to output the vibration driving voltage by which the piezoelectric element is vibrated the number of times having been changed.

11. The inkjet recording apparatus according to claim 10, wherein the ambient condition obtaining portion obtains a temperature condition, the zero shear viscosity calculating/obtaining portion calculates the zero shear viscosity based on the temperature condition obtained by the ambient condition obtaining portion, and the control portion changes the number of times the piezoelectric element is vibrated in the non-printing period, based on the zero shear viscosity calculated by the zero shear viscosity calculating/obtaining portion, and causes the application portion to output the vibration driving voltage by which the piezoelectric element is vibrated the number of times having been changed.

12. The inkjet recording apparatus according to claim 10, further comprising a storage portion in which zero shear viscosities of ink ejected from the nozzles are stored so as to be associated with predetermined temperatures, respectively, wherein the ambient condition obtaining portion obtains a temperature condition, the zero shear viscosity calculating/obtaining portion obtains the zero shear viscosity from the storage portion, based on the temperature condition obtained by the ambient condition obtaining portion, and the control portion changes the number of times the piezoelectric element is vibrated in the non-printing period, based on the zero shear viscosity obtained by the zero shear viscosity calculating/obtaining portion, and causes the application portion to output the vibration driving voltage by which the piezoelectric element is vibrated the number of times having been changed.

13. The inkjet recording apparatus according to claim 10, wherein the control portion changes the number of times the piezoelectric element is vibrated by changing a vibration period during which the piezoelectric element is vibrated, and causes the application portion to output the vibration driving voltage by which the piezoelectric element is vibrated the number of times having been changed.

14. The inkjet recording apparatus according to claim 13, wherein the control portion causes the application portion to output the vibration driving voltage by which the number of times the piezoelectric element is vibrated in the non-printing period is less than or equal to 2000.

15. The inkjet recording apparatus according to claim 10, wherein the control portion causes the application portion to output the vibration driving voltage by which the number of times the piezoelectric element is vibrated in the non-printing period is less than or equal to 2000.

16. The inkjet recording apparatus according to claim 15, wherein the control portion causes the application portion to output a vibration driving voltage by which the number of times the piezoelectric element is vibrated in the non-printing period is less than or equal to 500 in the case of the zero shear viscosity being less than or equal to 5.0 mPa·s, ranges from 500 to 1000 in the case of the zero shear viscosity being higher than 5.0 mPa·s, and less than 9.0 mPa·s, and is greater than or equal to 1000 in the case of the zero shear viscosity being higher than or equal to 9.0 mPa·s.

17. The inkjet recording apparatus according to claim 10, wherein the control portion causes the application portion to output the vibration driving voltage by which the number of times the piezoelectric element is vibrated in the non-printing period is less than or equal to 500 in the case of the zero shear viscosity being less than or equal to 5.0 mPa·s, ranges from 500 to 1000 in the case of the zero shear viscosity being higher than 5.0 mPa·s, and less than 9.0 mPa·s, and is greater than or equal to 1000 in the case of the zero shear viscosity being higher than or equal to 9.0 mPa·s.

18. The inkjet recording apparatus according to claim 10, wherein the ambient condition obtaining portion can obtain a humidity condition, the control portion executes a first mode in which the control portion changes the number of times the piezoelectric element is vibrated in the non-printing period, based on the ambient condition obtained by the ambient condition obtaining portion, and the control portion does not cause the application portion to output the vibration driving voltage by which the piezoelectric element is vibrated the number of times having been changed, and a second mode in which the control portion changes the number of times the piezoelectric element is vibrated in the non-printing period, based on the ambient condition obtained by the ambient condition obtaining portion, and the control portion causes the application portion to output the vibration driving voltage by which the piezoelectric element is vibrated the number of times having been changed, and the control portion can switch between the first mode and the second mode, based on the humidity condition obtained by the ambient condition obtaining portion.

* * * * *